US006412199B1

(12) United States Patent
Quenzi et al.

(10) Patent No.: US 6,412,199 B1
(45) Date of Patent: Jul. 2, 2002

(54) ADJUSTABLE WING PLOW WITH FIXED PIVOT

(75) Inventors: Philip J. Quenzi, Atlantic Mine; Cal G. Niemela; Curt E. Niemela, both of Chassell, all of MI (US)

(73) Assignee: Blizzard Corporation, Calumet, MI (US)

( * ) Notice: Subject to any disclaimer, the term of this patent is extended or adjusted under 35 U.S.C. 154(b) by 0 days.

(21) Appl. No.: 09/689,524

(22) Filed: Oct. 12, 2000

(51) Int. Cl.[7] ..... E01H 5/06

(52) U.S. Cl. ..... 37/281

(58) Field of Search ..... 37/241, 281, 282, 37/283, 234, 232, 266, 279, 903, 269, 272, 274; 172/782, 786, 815, 816, 684.5

(56) References Cited

U.S. PATENT DOCUMENTS

| | | | | |
|---|---|---|---|---|
| 595,202 | A | 12/1897 | Pearson et al. | |
| 1,927,078 | A | 9/1933 | Weeks | 37/44 |
| 2,218,512 | A | 10/1940 | Ball | 37/42 |
| 2,299,451 | A | 10/1942 | Austin | 37/44 |
| 2,410,543 | A | 11/1946 | Kester | 37/44 |
| 2,524,329 | A | 10/1950 | Richardson | 37/44 |
| 2,643,470 | A | 6/1953 | Kaeser | |
| 3,157,099 | A | 11/1964 | Ulrich | |
| 3,250,026 | A | 5/1966 | Jocher et al. | 37/42 |
| 3,302,317 | A | 2/1967 | Domres | 37/179 |
| 3,378,084 | A | 4/1968 | Ulrich | 172/247 |
| 3,425,497 | A | 2/1969 | Strabala et al. | 172/792 |

(List continued on next page.)

FOREIGN PATENT DOCUMENTS

| | | |
|---|---|---|
| DE | 919474 | 7/1949 |
| EP | 140139 | 5/1985 |
| GB | 1037674 | 8/1966 |
| SE | 323974 | 5/1970 |

OTHER PUBLICATIONS

Commonly Assigned Co–Pending U.S. Patent Application, Ser. No. 09/243,908, filed Feb. 3, 1999 by Philip J. Quenzi et al. for Plow Hitch Assembly for Vehicles.

(List continued on next page.)

*Primary Examiner*—Robert E. Pezzuto
(74) *Attorney, Agent, or Firm*—Van Dyke, Gardner Linn & Burkhart, LLP

(57) ABSTRACT

A plow assembly for vehicles, such as pickup trucks and tractors, or bulldozers or graders, for moving snow or other plowable materials has at least one extendable, forwardly pivotable plow wing which is pivotable at a hinge at one end of a main plow for movement between an aligned position and a forwardly angled position in which the plow wing front surface extends at an angle to the plow front surface. The plow wing includes an inner and outer portion, whereby the outer portion is slidably mounted to the inner portion for sliding movement along the inner portion between a retracted and an extended position. One or more actuators, such as fluid power cylinders or the like, are connected to the plow wing to move the wing between the retracted, extended, aligned and forwardly angled positions. In one preferred embodiment, an extendable plow wing is pivotally mounted on each end of the main plow with a pair of fluid cylinders connected to each of the respective plow wings. The fluid cylinders in each respective pair are operable independently of one another to move the plow wings independently between their respective retracted, extended, aligned and forwardly angled positions. When both plow wings are pivoted to their forwardly angled positions, the plow assembly has a general U-shape which facilitates pushing snow or other material without the material slipping off the plow blade ends. The wings are extendable and retractable when the plow is in the U-shape in order to adjust the carrying capacity of the plow.

52 Claims, 16 Drawing Sheets

U.S. PATENT DOCUMENTS

| | | | | |
|---|---|---|---|---|
| 3,430,706 | A | 3/1969 | Marron | 172/802 |
| 3,477,151 | A | 11/1969 | Zanella | 37/42 |
| 3,657,828 | A | 4/1972 | Anderson | 37/46 |
| 3,775,877 | A | 12/1973 | Gove, Sr. | 37/42 |
| 3,803,733 | A | 4/1974 | Ramsey | 37/44 |
| 3,807,064 | A | 4/1974 | Schmidt, Jr. | 37/41 |
| 4,019,268 | A | 4/1977 | Waterman | 37/10 |
| 4,073,077 | A | 2/1978 | Essel et al. | 37/50 |
| 4,074,448 | A | 2/1978 | Niemela | 37/41 |
| 4,099,578 | A | 7/1978 | Stevens | 172/802 |
| 4,145,825 | A | 3/1979 | Bertolino | 37/42 |
| 4,196,532 | A | 4/1980 | Muller | 37/105 |
| 4,249,323 | A | 2/1981 | Mathis et al. | 37/42 |
| 4,275,514 | A | 6/1981 | Maura | 37/42 |
| RE31,045 | E | 10/1982 | Essell et al. | 37/281 |
| 4,356,645 | A | 11/1982 | Hine et al. | 37/281 |
| 4,369,847 | A | 1/1983 | Mizunuma | 172/815 |
| 4,372,617 | A | 2/1983 | Zamboni | 229/24 |
| 4,479,312 | A | 10/1984 | Turgeon | 31/219 |
| 4,614,048 | A | 9/1986 | Melby | 37/280 |
| 4,658,519 | A | 4/1987 | Quenzi | 37/23 |
| 4,667,426 | A | 5/1987 | Howard et al. | 37/232 |
| 4,723,609 | A | 2/1988 | Curtis | 172/815 |
| 4,779,363 | A | 10/1988 | Boutrais et al. | 37/117 |
| 4,834,191 | A | 5/1989 | Vecchio | 172/784 |
| 4,962,600 | A | 10/1990 | Zellaha et al. | 37/280 |
| 5,165,191 | A | 11/1992 | Davis | 37/117.5 |
| 5,285,588 | A | 2/1994 | Niemela et al. | 37/234 |
| 5,375,349 | A | 12/1994 | Jochim | 37/429 |
| 5,392,538 | A | 2/1995 | Geerligs et al. | 37/268 |
| 5,411,102 | A | 5/1995 | Nickels et al. | 172/781 |
| 5,638,618 | A | 6/1997 | Niemela et al. | 37/281 |
| 5,829,174 | A | 11/1998 | Hadler et al. | 37/234 |
| 5,899,007 | A | 5/1999 | Niemela et al. | 37/281 |

OTHER PUBLICATIONS

*Farm Industry News*, vol. 23, No. 7, Jul./Aug. 1990, p. 25.

Publication "Still Out Front in Productivity," Excel Industries, Inc., ©1988.

"Snow Track 440", Publication, Excel Industries, 1989.

Snow Craft Industries, Inc. Publication, Sedalla, Colorado, published more than one year prior to the filing date of this application no date.

Commonly Assigned, Co–Pending U.S. Patent Application, Ser. No. 09/689,494, filed Oct. 12, 2000 by Philip J. Quenzi et al., for Adjustable Wing Plow.

Commonly Assigned, Co–Pending U.S. Patent Application, Ser. No. 09/689,004, filed Oct. 12, 2000 by Philip J.Quenzi et al., for Plow with Rear Mounted, Adjustable Wing.

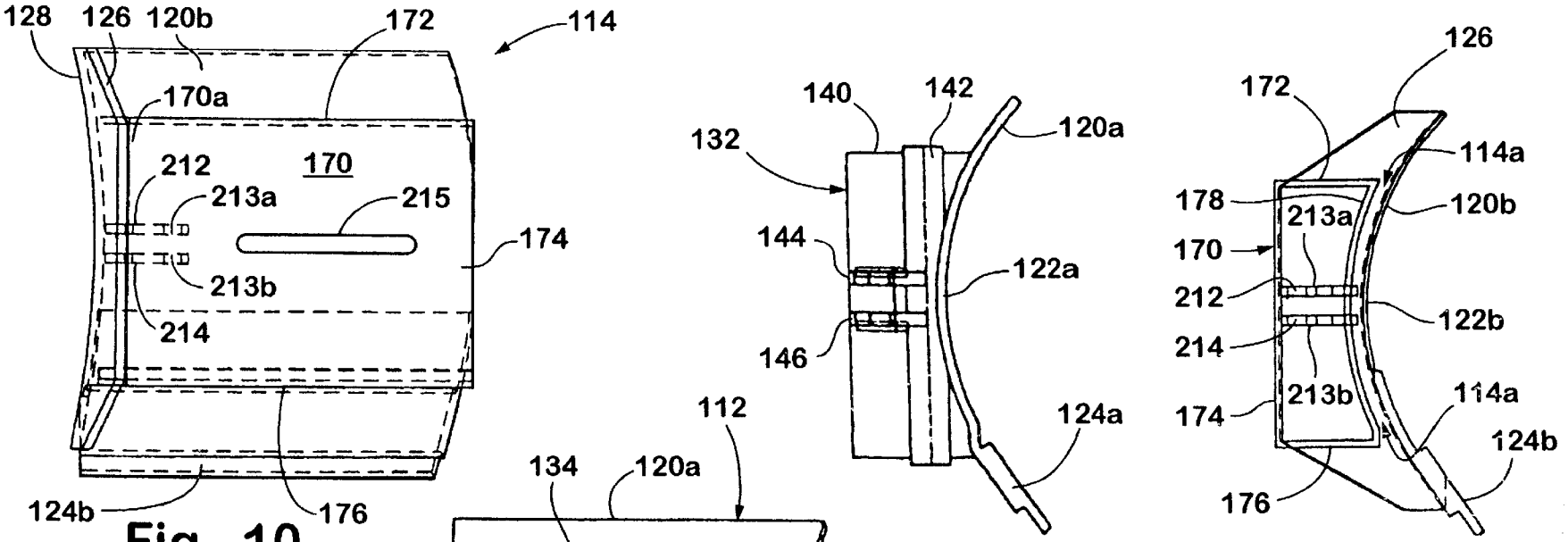
Fig. 10
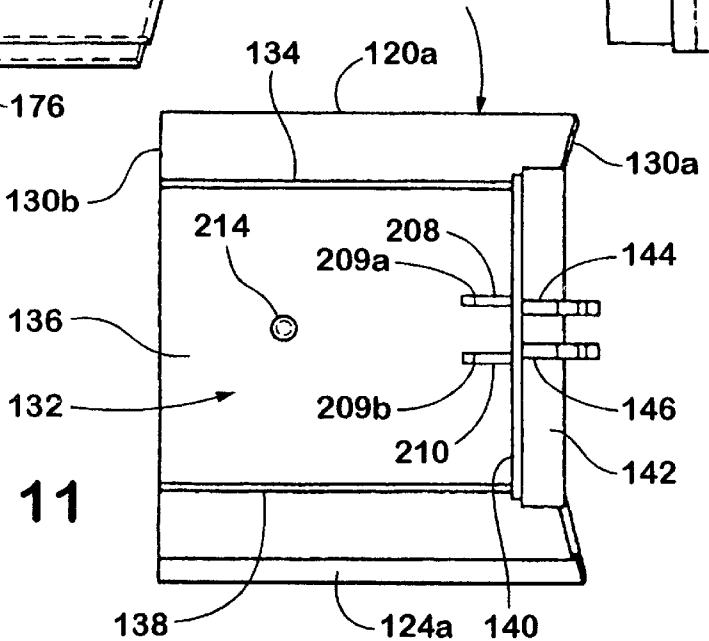
Fig. 11
Fig. 12
Fig. 13

10

ADJUSTABLE WING PLOW WITH FIXED PIVOT

FIELD OF THE INVENTION

This invention relates to plows fitted on vehicles for moving snow, dirt, sand, gravel and other plowable, excavatable materials and, more particularly, to a plow for snow and other materials for use with pickup trucks, dozers, graders and other vehicles having plow wings which are individually adjustable for both extension of the main plow and forward angling of the wings for positioning the plow to prevent snow or other plowed material from slipping off the ends of the plow.

BACKGROUND OF THE INVENTION

A wide variety of snow plows for pickup trucks and other utility vehicles are available and in use. These include straight bladed plows of the type shown in U.S. Pat. No. 3,250,026, and center-hinged, V-plows of the type show U.S. Pat. Nos. 4,074,448 and 4,658,519. Other straight bladed plows have been devised with one or both ends being slidably extendable as shown in U.S. Pat. Nos. 2,218,512; 3,807,064; and Swedish 323,974. Yet other plows have included straight blades with pivotable, non-extendable ends as shown in U.S. Pat. Nos. 4,145,825 and 3,477,151. At least one plow is shown in EPO 140,139 having permanently forwardly angled plow ends, which forwardly angled plow ends include slidable extensions wherein the entire plow swings from side to side so as to angle the entire plow left or right.

While each of the above types of prior known plows is useful in one or more situations, the overall flexibility for use of these plows has been limited. For example, for truck mounted plows which must be transported from one site to another for clearing snow or other plowable materials, it is necessary that the plow be short enough to allow transport on public highways which have limited lane width. However, when actually engaged in plowing, it is very helpful to have a greater length for the plow so that larger areas of the parking lot or other site can be cleared of snow more quickly. Yet another problem encountered is when large amounts of snow or other plowable material must be pushed or carried with the plow from one area of a clearing site to another such as the side of a parking lot. Many of the above mentioned plows allow snow or other material being cleared to slip off the ends of the plow thereby requiring additional time and work to completely clear the site.

Plows have been proposed which provide adjustable wings which are extendable and retractable and may be pivoted forwardly from their extended positions to form a generally U-shaped plow. For example, such plows are disclosed in U.S. Pat. Nos. 5,638,618 and 5,899,007. The plow wings are fully extended laterally from the plow and may be angled forwardly to form the generally U-shaped plow.

Many existing, prior known plows have, therefore, failed to provide a plow with sufficient flexibility to handle the varying needs encountered in plowing using pickup trucks or other vehicles, especially when such vehicles must be driven on public highways or when excavating or grading using a bulldozer, grader or the like. Such needs include a short enough plow length to allow transportation on public highways, a long enough length for fast, efficient clearing of a job site, and the carrying or pushing of plowable material from one area to another without allowing the plowed material to slip off the plow ends. In addition, plows should be as light in weight as possible while sufficiently strong to withstand the various forces imposed thereon during plowing of various materials. The plows should also allow for proper visibility during use as well as when moved to a non-use position on the vehicle, and should allow ease in repair or replacement of those parts subject to high wear during plowing use. All of these results should be accomplished while minimizing the size and space required for the plow in each of its arrangements.

SUMMARY OF THE INVENTION

Accordingly, the present invention provides a plow having adjustable wings on its ends which can be adjusted to varying positions to allow transport on public highways, to provide increased plow length for fast, efficient clearing of snow or other material being plowed, and to allow carrying or pushing of plowable material from one area to another without the plowed material slipping off the plow ends. The present plow may be configured in various arrangements to handle each of these situations while minimizing the size and space required by the plow when in position on the vehicle. The present plow also allows adjustment to meet these various situations from a remote position in the cab of the vehicle without external, hands on adjustment.

According to an aspect of the present invention, a plow assembly for vehicles comprises a plow, a support for attaching the plow to the vehicle, an extendable plow wing, and at least one actuator connected to the plow wing. The plow has a front material engaging surface. The plow further includes a hinge member at one end of the plow. The plow wing is pivotally mounted to the hinge member and has an inner portion pivotally mounted at the hinge and an outer portion slidably mounted to the inner portion. Each of the inner and outer portions has a front material engaging surface. The outer wing portion is mounted for sliding movement along the inner wing portion between a retracted position in which an outer end of the outer wing portion is adjacent an outer end of the inner wing portion, and an extended position in which the outer end of the outer wing portion is spaced outwardly of the retracted position. The inner wing portion is pivotally mounted on the hinge member for movement between an aligned position in which the front surface of the inner and outer wing portions are generally aligned with the front surface of the plow, and a forwardly angled position in which the front surfaces of the plow wing extend at an angle to the front surface of the plow. The actuator is operable to move the outer wing portion between the retracted and extended positions, and to move the plow wing between the aligned and forwardly angled positions.

Preferably, the plow assembly includes a plow wing at each end of the plow. Both plow wings are movable between the extended and retracted positions and movable between the aligned and forwardly angled positions with respect to the plow. Preferably, the plow assembly includes two pair of actuators, such as hydraulic cylinders or the like. Each pair of actuators is operable to move one of the plow wings with respect to the plow. Preferably, one of the actuators of each pair is operable to move the outer wing portion along the inner wing portion between the extended and retracted positions, while the other actuator of the pair is operable to move or pivot the respective plow wing about the hinge between the aligned and forwardly angled positions. Preferably, the actuators are independently controlled such that the plow wings may be extended and/or pivoted as desired by the operator of the plow assembly.

According to another aspect of the present invention, a plow assembly for vehicles, comprises a plow, a support for attaching the plow to the vehicle, first and second extendable plow wings, first and second slides, and at least one actuator for moving the plow wings relative to the plow. The plow has opposite ends, a front material engaging surface, and a hinge member at each of the opposite ends. The front material engaging surface of the plow has a generally continuous uninterrupted surface. Each plow wing has inner and outer wing portions, each of which preferably has a cross-sectional contour corresponding to the plow and a front material engaging surface. The outer wing portion of each plow wing is mounted for sliding movement along the inner wing portion of the respective plow wing. Each of the plow wings is movable between a retracted position in which an outer end of the outer wing portion is adjacent an outer end of its respective inner wing portion, and an extended position in which the outer end of the outer wing portion is spaced outwardly from the retracted position. Each plow wing is pivotally mounted on a respective one of the hinge members for movement between an aligned position in which the front surface of the plow wing and the front surface of the plow are generally aligned, and a forwardly angled position in which the front surface of the plow wing extends at an angle to the front surface of the plow. The slides are movable along the rear surface of the inner wing portions of a respective plow wing. The outer wing portion of each plow wing is mounted on and movable with a respective slide. Preferably, each of the plow wings is movable independently of the other plow wing, such that the plow wings are independently movable between the retracted, extended, aligned and forwardly angled positions.

In one form, the actuator includes two pair of actuators, each pair being operable to move one of the plow wings. One actuator of each pair is operable to move the slide, and thus the outer wing portion, along the inner wing portion between the extended and retracted position, while the other of the actuators of each pair is operable to move or pivot the plow wing about the hinge member between the aligned and forwardly angled positions. Each of the actuators are preferably operable independently of the other actuators and plow wing such that the plow wings are independently movable between the retracted, extended, aligned and forwardly angled positions.

The plow is preferably pivotally mounted on the support for movement about a first, generally vertical pivot axis from a centered position extending generally transverse to the longitudinal axis of the vehicle, to a series of angled positions in which the plow is angled to the left or right of the centered position.

Accordingly, the present plow assembly provides numerous advantages over prior known plows. The present plow has sufficient flexibility to handle varying needs including being short enough in length when not extended to allow transport on public highways without projecting into adjacent lanes, being extendable to a sufficient length to allow fast, efficient clearing of the snow or other plowable material being plowed from a large area, and yet is configurable with either one or both the wings angled forwardly for highly efficient carrying and/or pushing of plowed material from one location in the area being plowed to another without the plowed material slipping off the plow ends. The wings are adjustable forwardly irrespective of the degree of extension of the wings, such that one or both wings may be angled forwardly when in either the extended or retracted position, or in a partially extended position. Additionally, the wings may be extended after they are forwardly angled, in order to increase the carrying capacity of the U-blade configuration in response to the type and/or consistency of the material being moved or plowed. All of these functions are accomplished in the present plow with a minimal size and space due to its compact and efficient construction. Preferably, the plow may be centered for pushing or carrying of material, or angled to one side or the other for moving material to the side of the vehicle supporting the plow. One or both plow wings at the ends of the plow may be extended or pivoted forwardly independently or together, while the entire plow may be centered or angled to one side or the other with one or both of the plow wings extended or pivoted forwardly. In either case, the plow wings at either end of the main plow are independently extendable and movable to a forwardly angled position via remote control from the cab of the vehicle by means of at least one actuator, such as an hydraulic fluid cylinder or the like, mounted along the back of the plow. The main plow blade and both the inner and outer portions of the wings all provide a generally continuous, uninterrupted front surface of their respective moldboards. This avoids the possibility of dirt, ice or other materials becoming lodged or embedded in the movable mechanisms of the plow wings, since these mechanisms are positioned behind the uninterrupted moldboards of the plow assembly. This not only may improve the operation of the plow wings when plowing, grading or excavating, but may also increase the life cycle of the plow wings and their associated components.

In addition, both the main plow and the extendable wings are pivotable forwardly on a horizontal axis in the event an obstacle is encountered during plowing. Further, when the plow wings are extended, if the vehicle is moved in reverse and a quantity of snow or other material being plowed engages the rear surface of either plow wing, either a latch mechanism or an actuator or fluid cylinder maintains the plow wing in alignment with the plow blade and prevents movement to the forwardly angled position until desired. In addition, the extendable, adjustable plow of the present invention has been designed in a highly compact, lightweight manner allowing use on a wide variety of pickup trucks, tractors and other vehicles as well, including bulldozers, graders or other excavation or construction vehicles or equipment. It may be supported at the front of a vehicle via a support frame or by means such as vertical supports positioned behind the plow assembly such as in a road grader. In addition, the plow assembly of the present invention is rugged, strong and highly durable to allow use in harsh weather or environmental conditions over an extended period of time.

These and other objects, advantages, purposes and features of the invention will become more apparent from a study of the following description taken in conjunction with the drawings.

BRIEF DESCRIPTION OF THE DRAWINGS

FIG. 10 is a rear elevation of the outer portion of the extendable plow wing of FIG. 8;

FIG. 11 is a rear elevation of the inner portion of FIG. 9;

FIG. 12 is an inner end elevation of the inner portion of FIGS. 9 and 11;

FIG. 13 is an inner end elevation of the outer portion of FIG. 10;

DESCRIPTION OF THE PREFERRED EMBODIMENTS

Figure 1:
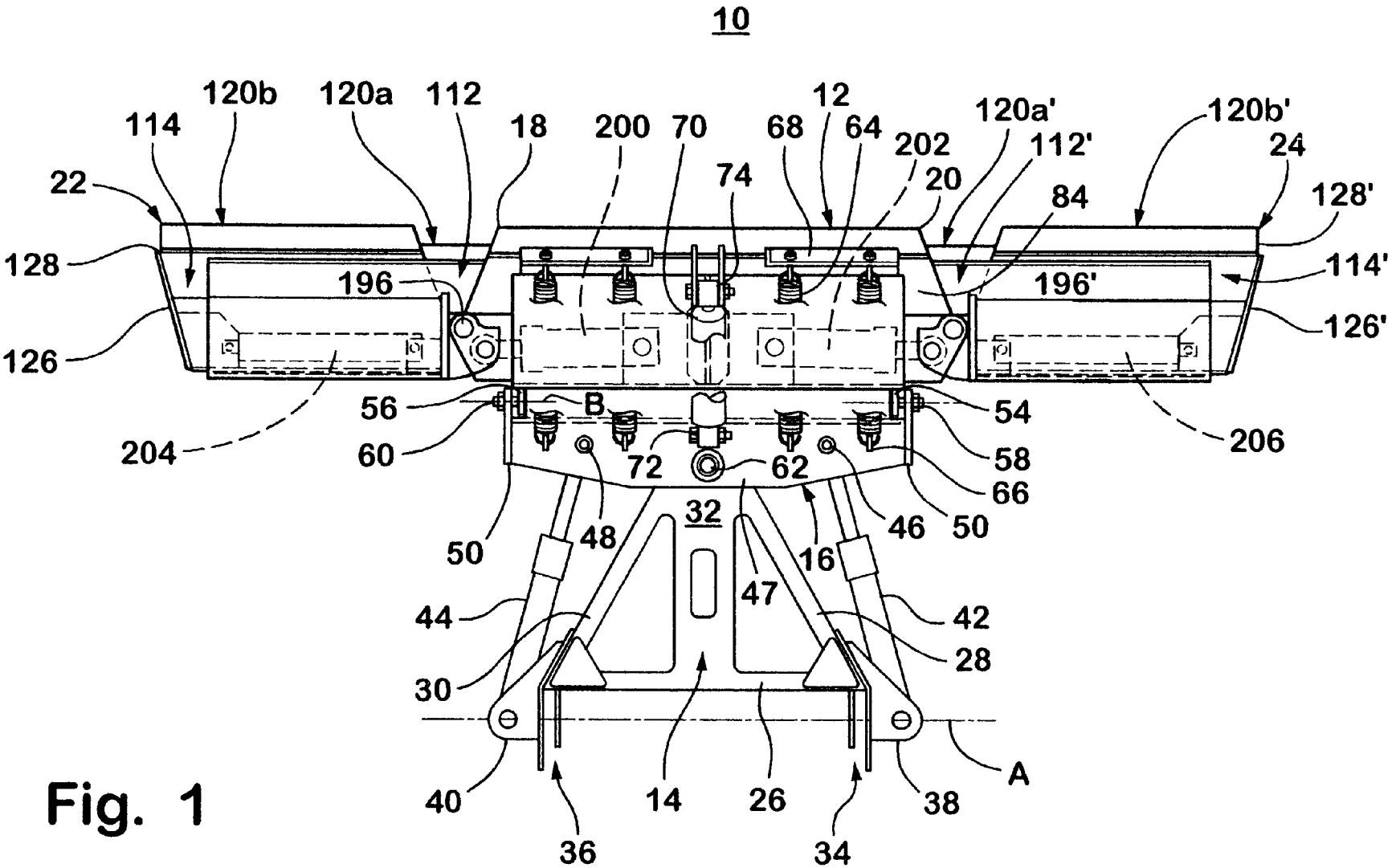
FIG. 1 is a top plan view of the adjustable wing plow assembly of the present invention, wherein the plow wings are retracted and aligned with the plow and the plow is centered on a support frame, with the actuators shown in phantom.

Referring now to the drawings in greater detail, an adjustable wing plow assembly 10 includes a reinforced main plow 12 pivotally mounted on a support frame 14 via an intermediate support 16. Slidably mounted at opposite ends 18, 20 of main plow 12 are extendable plow wings 22, 24, each of which are moved by at least one and, in certain embodiments, two actuators, such as fluid power cylinders 200, 202, 204 and 206 (FIG. 5), remotely controlled from the cab of the pickup truck or other vehicle on which the plow assembly 10 is mounted. Wings 22, 24 are independently slidably movable between retracted positions as shown in FIGS. 1–5, fully extended positions as shown in FIGS. 14–17, and forwardly angled positions in which the plow assembly has a generally U-shaped configuration shown in FIGS. 18–27. Plow assembly 10 is primarily adapted for plowing snow when attached to the front of a transport vehicle such as a pickup truck, tractor, or other vehicle via support frame 14. However, other materials such as gravel, sand, dirt, bark mulch, and the like can also be moved with the plow, which may alternately be mounted on other vehicles, such as a bulldozer, grader or other excavation or construction equipment. In addition, plow 12 can be mounted in other ways besides support frame 14, such as by vertical supports secured to the rear of the plow as explained more fully below.

Both support frame 14 and intermediate support 16 are shown in FIG. 1 and are preferably similar to the support frame and intermediate support disclosed in commonly assigned U.S. Pat. Nos. 5, 638,618 and 5,899,007, which are hereby incorporated herein by reference, such that a detailed discussion of the support frame and intermediate support need not be included herein. However, plow assembly 10 may be mounted to a vehicle via any other mounting means, such as via conventional mounting frames or supports, without affecting the scope of the present invention. The plow assembly 10 is shown without the support frame and the intermediate support in FIGS. 2–29. Suffice it to say that, as shown in FIG. 1, support frame 14 is of the type suitable for attachment to the front of a pickup truck or the like and preferably includes a triangularly shaped, reinforced framework having a base 26, inwardly tapering sides 28, 30 leading to a forward apex 32, and spaced pairs of rearwardly extending support flanges 34, 36 on base 26 adapted to allow frame 14 to be secured to a suitable hitch assembly on the front of a pickup truck or other vehicle for pivotal movement about a horizontal axis A extending through the support flanges. Laterally extending pairs of vertically spaced cylinder support flanges 38, 40 extend outwardly from the opposite sides 28, 30 of frame 14 and the outermost support flanges 34, 36. A pair of extendable, single acting, hydraulic fluid cylinders 42, 44 are pivotally mounted, one on either side of frame 14, between cylinder support flanges 38, 40 and pivot pins 46, 48 on intermediate support 16. Pins 46, 48 extend between an upper plate 47 and a lower plate (not shown) spaced below upper plate 47, of intermediate support 16.

Intermediate support 16 is an elongated steel beam having a generally U-shaped configuration in cross section (FIG. 1), upper plate 47, the lower plate, and a forward plate (also not shown), and pairs of plow mounting flanges 50 welded to the ends of the plates and projecting forwardly toward the rear surface of plow 12. Plow 12 preferably includes rearwardly extending, vertically oriented supports or mounting flanges 54, 56 extending between flanges 50, for mounting on horizontal rods 58, 60 aligned on a common horizontal axis B (FIG. 1) to allow the entire plow 12 to pivot about that horizontal axis. Intermediate support 16 is, in turn, pivotally mounted to apex 32 of support frame 14 by a generally vertically extending pivot pin 62.

Figure 30:
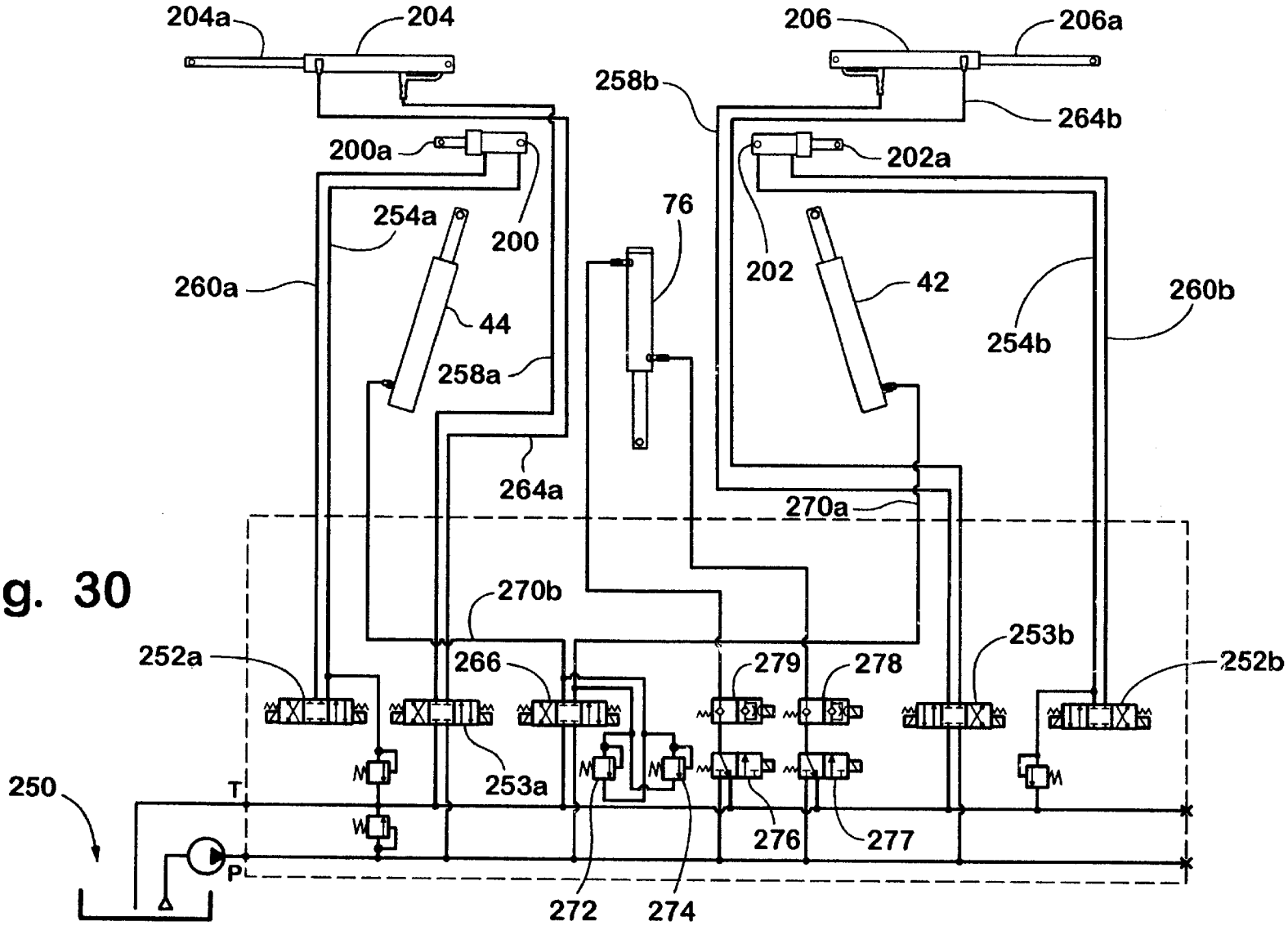
FIG. 30 is a schematic illustration of the hydraulic system for operation of the adjustable plow assembly of the present invention.

By controlling the extension and retraction of actuators or fluid cylinders 42, 44, intermediate support 16 and plow 12, which is mounted thereon, may be moved to a series of angled positions such that plow 12 is swung and angled to the left or right about pivot pin or axle 62. Plow 12 is biased to an upright position about horizontal axis B on pins 58, 60 by a series of biasing members such as coil springs 64 which extend between mounting flanges 66 extending upwardly from the top surface of intermediate support 16 and support flanges 68 at the top of rear surface 84 of plow 12. In addition, a shock absorber 70 is pivotally mounted between upstanding support flanges 72 on intermediate support 16 and rearwardly extending support flanges 74 on the rear surface 84 of plow 12. Shock absorber 70 and springs 64 are shown in FIG. 1 with their middle portions cut away to reveal additional details of plow assembly 10, as discussed below. Shock absorber 70 dampens the pivotal movement of plow assembly 10 about horizontal axis B on pins 58, 60 during plowing when the plow encounters an obstacle along the surface being plowed thereby causing the plow 12 with wings 22, 24 to tip or pivot forwardly against the bias of springs 64. Rearward pivoting of the plow about axis B on pins 58, 60 is limited by the rear, vertical edges of flanges 54, 56 which engage the forward plate on intermediate support 16. Forward pivotal movement is limited by springs 64 and shock absorber 70. When support frame 14 is pivotally secured to a horizontal axis A on a vehicle via support flanges 34, 36, the entire support frame 14, intermediate support 16 and plow 12 including extendable wings 22, 24 may be lifted away from the ground or other support surface via an extendable and retractable actuator or hydraulic cylinder 76 (FIG. 30). Cylinder 76 is preferably pivotally mounted between the support frame 14 and a suitable mounting point on the pickup truck or other vehicle.

As shown in FIGS. 1–3, 5 and 14–17, main plow 12 is preferably an elongated, rectilinear steel moldboard 80 having a concave front surface 82 and a convex rear surface 84. Secured to a lower flange which extends along the lower edge of moldboard 80 is a replaceable elongated, rectilinear plow blade 90 secured thereto. Plow blade 90 may be secured to moldboard 80 via any known means, such as by fasteners (not shown) having countersunk heads which are flush with the front surface of blade 90 to prevent interference with the material being plowed. Alternately, carriage bolts having rounded heads could be used as fasteners. Clearly, other means for securing a blade to the moldboard, or of forming the blade as part of the moldboard, may be implemented without affecting the scope of the present invention. Front surface 82 of moldboard 80 is preferably a generally continuous, uninterrupted surface. The outer ends of moldboard 80 are curved (FIG. 2) so as to align with the front surface of wing extensions 22, 24 when plow extensions 22, 24 are angled forwardly as shown, for example, in FIGS. 18–27. The rear surface 84 of moldboard 80 is preferably reinforced with vertically extending supports or mounting flanges 54, 56 (FIG. 1) on either side of its center, as well as other reinforcing or support flanges (not shown) welded to rear surface 84 adjacent either end.

Rectilinear moldboard 80 is preferably formed of a steel or other strong durable material. However, it is envisioned that the moldboard may alternately be formed in two sections, similar to the moldboard disclosed in U.S. Pat. No. 5,899,007. For example, moldboard 80 may include a first, steel section, which extends from the top of plow blade 90, and a second, upper, curved section of the moldboard, which is preferably formed from a polymeric sheet material such as opaque ultra high molecular weight (UHMW) polyethylene or clear polycarbonate. Accordingly, when material to be plowed, such as snow, sand, dirt, gravel or other plowable material, engages the plow blade 90 it is forced upwardly along the first moldboard section, which bears the principal amount of force causing the material to change directions, while the remainder of the first section and the second section impart a rolling action or a continuation of the change in direction to force the snow forwardly as the plow is moved in the same direction. The polymeric sheet material of the second section may save a significant amount of weight in the overall plow assembly, and also may provide the ability to view through the upper section of the plow, especially when the plow assembly is raised to its inoperative position when mounted on a truck. However, moldboard 80 may be unitarily formed of steel or polymeric materials, and may be formed with the plow blade, without affecting the scope of the present invention.

On the rear surface 84 of moldboard 80 is welded a rectangular, steel housing 100 having a top wall 102, bottom wall 104, and rear wall 106 forming a generally U-shaped enclosure. As will be explained below, housing 100 is adapted to receive actuators 200, 202. Alternately, an open frame structure or the like may be provided on rear surface 84 of moldboard 80 to facilitate easier access to the actuators, without affecting the scope of the present invention. A pair of parallel hinge plates 179, 180 are welded to the top and bottom walls 102, 104, respectively, at the ends of plow 12. Hinge plates 179, 180 project outwardly from the outer ends of plow 12 and provide vertically spaced, vertically aligned apertures 182*a*, 182*b* (FIG. 20) in the projecting portion of the hinge plates. On the inner surface of rear wall 106, spaced, parallel cylinder mount plates 188, 190 (FIG. 5) are welded to the inner surface of rear wall 106 and/or to the rear surface of plow 12. Mount plates 188, 190 may also be welded or otherwise secured to a central vertical support plate 186, which is positioned within housing 100 to further strengthen and support plow 12 and housing 100. Mount plates 188, 190 provide two pair of vertically aligned apertures 192*a, b* and 194*a, b* (FIG. 22) which receive pivot pins for mounting the inner ends of actuators 200, 202 for operating the wing extensions as will be more fully explained below.

The mounting flanges 54, 56 and any reinforcing or support flanges preferably extend over top wall 102, along rear wall 106 and thereafter along bottom wall 104 of housing 100 and are welded thereto to reinforce the entire assembly. Additional reinforcement for main plow 12 may be provided by other reinforcing plates (not shown) welded to housing 100 between rear wall 106 and bottom wall 104. In addition, a pair of support skids, shown in phantom at 216 in FIG. 6, may be telescopingly mounted to rear wall 106 and/or to a reinforcing plate at each end of plow 12. The skids, which include concave shoes 216*a*, extend downwardly to engage the ground or pavement surface and support blade 90 at the proper height above that surface. Preferably, the skids are adjustable to maintain the proper clearance of blade 90 as the blade wears during use, such as by a series of removable washers (not shown) stacked on a shaft 216*b* of the skid 216.

As is best seen in FIGS. 1–5 and 14–27, each plow wing extension 22, 24 is a substantial mirror image of the other, only one being described in detail herein, namely, plow wing 22. Substantially the same elements are included in plow wing extension 24 but are shown with prime numerals.

Figure 7:
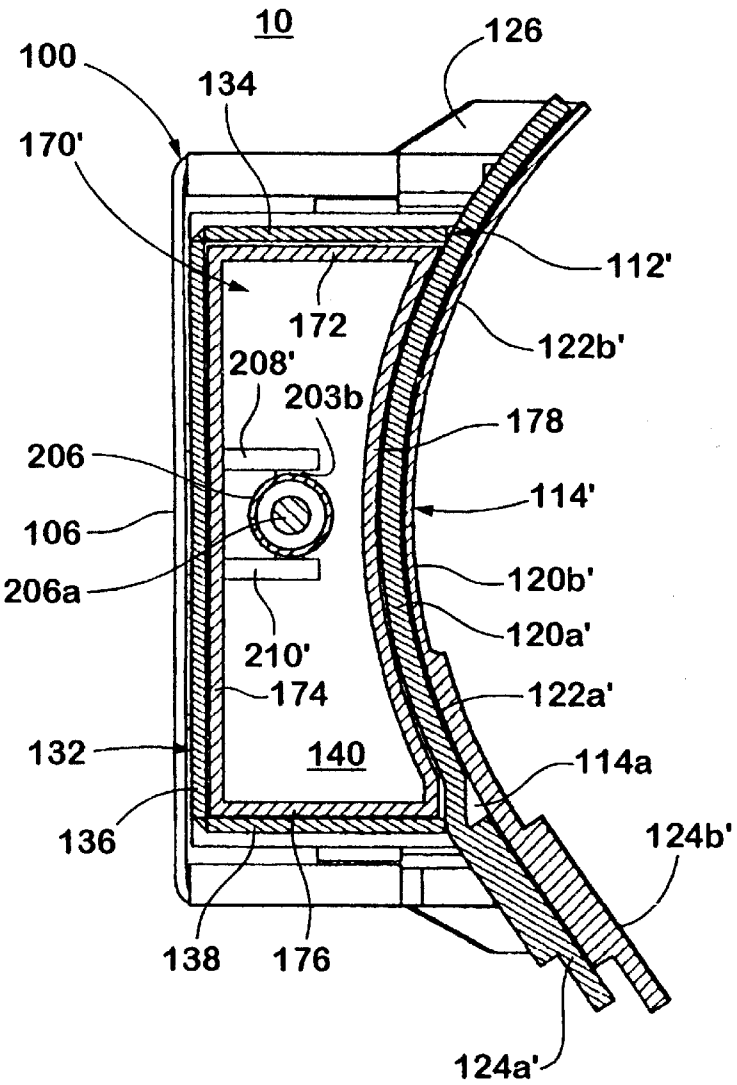
FIG. 7 is a sectional view of the plow assembly taken along the line VII—VII in FIG. 5.
Figure 6:
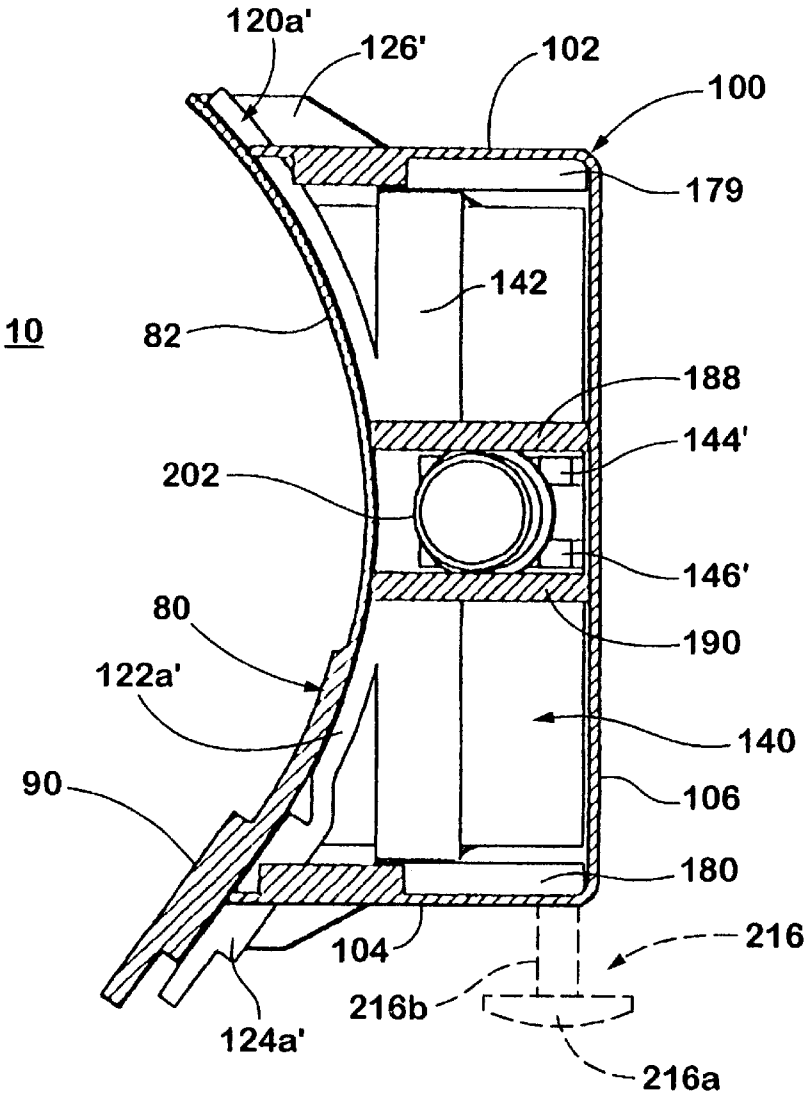
FIG. 6 is a sectional view of the plow assembly taken along the line VI—VI in FIG. 5.

As is best seen in FIGS. 6, 7, and 10–13, plow wing extension 22 includes an inner portion or wing 112 and an outer portion or wing 114. Each portion 112, 114 includes a respective moldboard section 120*a*, 120*b*, which has a radius of curvature substantially the same as that for moldboard 80 and extends generally parallel to moldboard 80 when mounted on the plow assembly. A steel extension blade 124*a*, 124*b*, also known as a cutting edge or wear edge, is secured to a front surface 122*a*, 122*b* of the lower edge of moldboard 120*a*, 120*b*, respectively, and extends generally parallel to plow blade 90, as shown in FIGS. 6 and 7. Blades 124*a*, 124*b* engage the plowed surface during plowing and may be repaired or replaced when worn. Similar to moldboard 80, front surfaces 122*a*, 122*b*, moldboards 120*a*, 120*b* are also generally continues and uninterrupted surfaces. A generally vertical reinforcing flange 126 extends along the outermost edge 128 of moldboard 120*b* of outer wing extension 114, and connects or mounts moldboard 120*b* to slide member 170, as discussed below. The innermost edge 130*a* of inner moldboard 120*a* is curved outwardly, as best shown in FIGS. 11, 22, 26 and 27, while an outer edge 130*b* of inner moldboard 120*a* may be generally straight or vertical.

Extending parallel to the upper and lower edges of inner wing portion 112 of wing extension 22 on the rear surface thereof is a slide support or housing 132, best seen in FIGS. 3, 6–9, 16, 20, 21, 25 and 26. Housing 132 is preferably formed from sheet steel bent into a generally U-shaped configuration and welded or otherwise secured to the rear surface of moldboard 120*a*. Housing 132 includes an upper wall 134, a rear wall 136 and a lower wall 138. As will be understood from FIGS. 15, 16, and 25, housing 132 is slightly larger than slide member 170. Optionally, synthetic, elongated wear pad strips (not shown) may be secured to the inner surfaces of housing walls 134, 136 and 138 and/or to slide members 170, 170' to slidably support the slide members inside housing 132. Preferably, the wear pads are formed from ultra high molecular weight (UHMW) plastic, although other materials such as Teflon, steel and/or other materials could also be used. However, one or more of the walls of slide member 170 may engage the inner surface of housing 132 to slidingly support the slide member 170 along and within the housing. Optionally, suitable lubricants may also be used to enhance sliding of the slide members along the slide support or housing as desired. Alternately, the slide support may be an opened frame structure or upper and lower support rails or the like to movably support slide member 170 therealong, without affecting the scope of the present invention. Such a mounting scheme facilitates easier access to the actuators 204, 206.

With reference to FIGS. 8, 9, 11 and 12, a vertical support plate 140 is welded to the edges of the housing 132 at the inner edge of inner portion 112 of wing extension 22. At the forward most edge of support plate 140, adjacent the inner edge 130*a* of moldboard 120*a*, is a vertically oriented hinge support tube or hinge cylinder 142 welded to plate 140. Intermediate the ends of support tube 142 are a pair of spaced hinge plates 144, 146 which are welded to both support tube 142 and support plate 140 and extend parallel to one another outwardly away from the inner edge of the inner portion 112 of plow wing 22. A vertical hinge pivot axis X is provided by support tube 142 while an actuator pivot axis Y is provided by aligned apertures 148*a*, 148*b* extending through hinge plates 144, 146. Hinge pivot axis X is offset from actuator pivot axis Y by a predetermined distance creating a moment arm which provides torque for pivoting the wing extension on its hinge axis as will be explained more fully below. At a side of support plate 140 opposite tube 142 and plates 144, 146 is mounted a pair of actuator support plates 208, 210, best seen in FIGS. 9 and 11, which extend from support plate 140 and define a pair of apertures 209*a*, 209*b* for mounting actuators 204, 206 to plates 208, 210 and 208', 210' of inner wing portions 112, 112', respectively.

Inner portion 112, 112' of each plow wing extension 22, 24 is pivotally mounted to the end of main plow 12. Outer portions 114, 114' of plow wings 22, 24 are slidably mounted to inner portions 112, 112' via a generally rectangular slide member 170, 170', only one of which is described in detail herein. Slide member 170 of outer wing portion 114, or slide member 170' of outer wing portion 114', is adapted to be slidably mounted telescopingly within the respective housing 132, 132' on the rear surface of inner portion 112, 112', to allow extension and retraction of outer portion 114, 114' of plow wing 22, 24 by actuator 204, 206, as referenced above and as explained more fully below.

As is best seen in FIGS. 8, 10, 13, 14 and 17, each slide member 170, 170' is an elongated beam having a generally rectangular cross section, formed from welded steel, and including a top wall 172, rear wall 174, bottom wall 176, and concave front wall 178. The cross-sectional shape generally corresponds to the cross-sectional shape of housing 132.

Figures 8, 9:
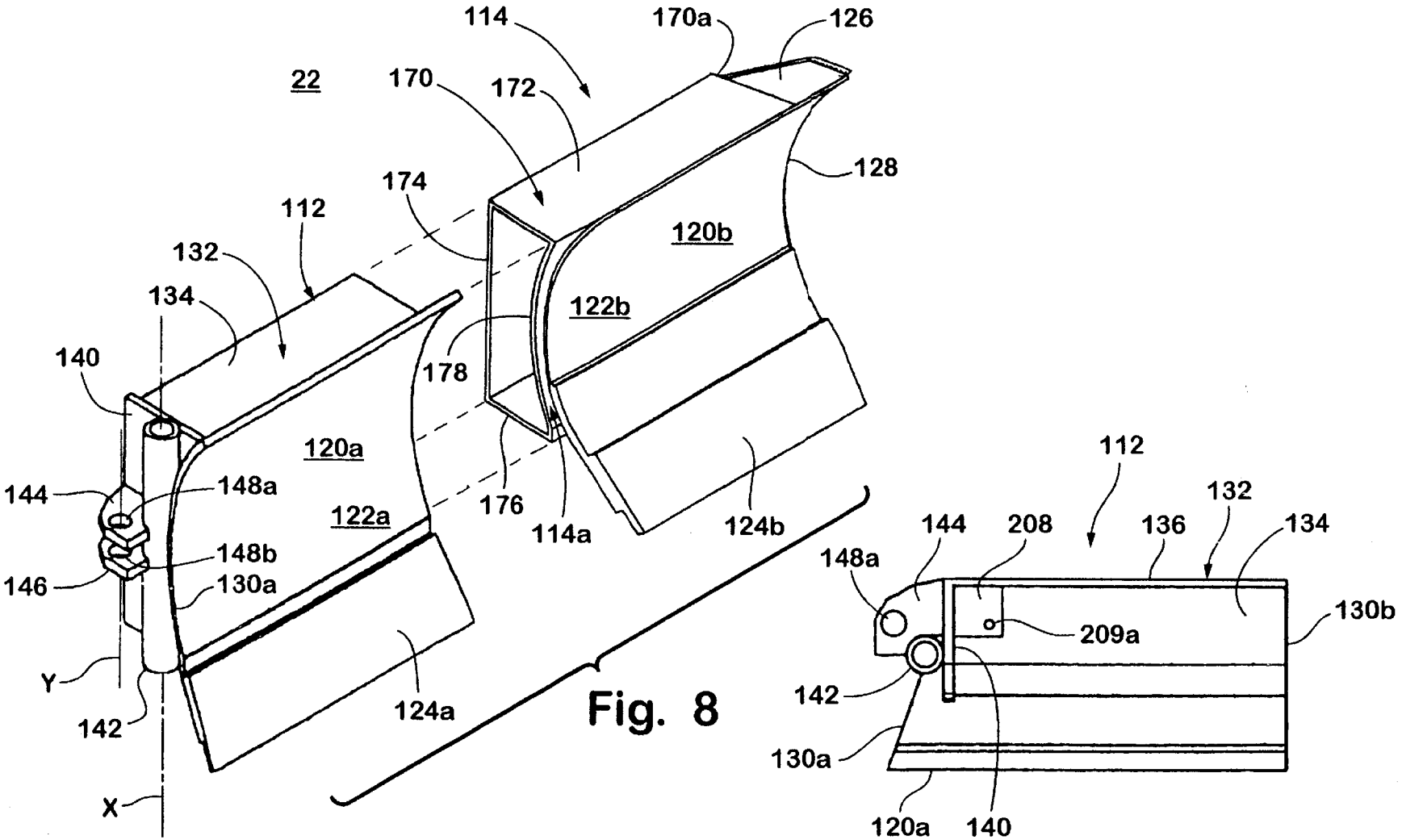
FIG. 8 is an exploded front perspective view of an extendable plow wing of the present invention.
FIG. 9 is a top plan view of the inner portion of the extendable plow wing of FIG. 8.
Figure 14:
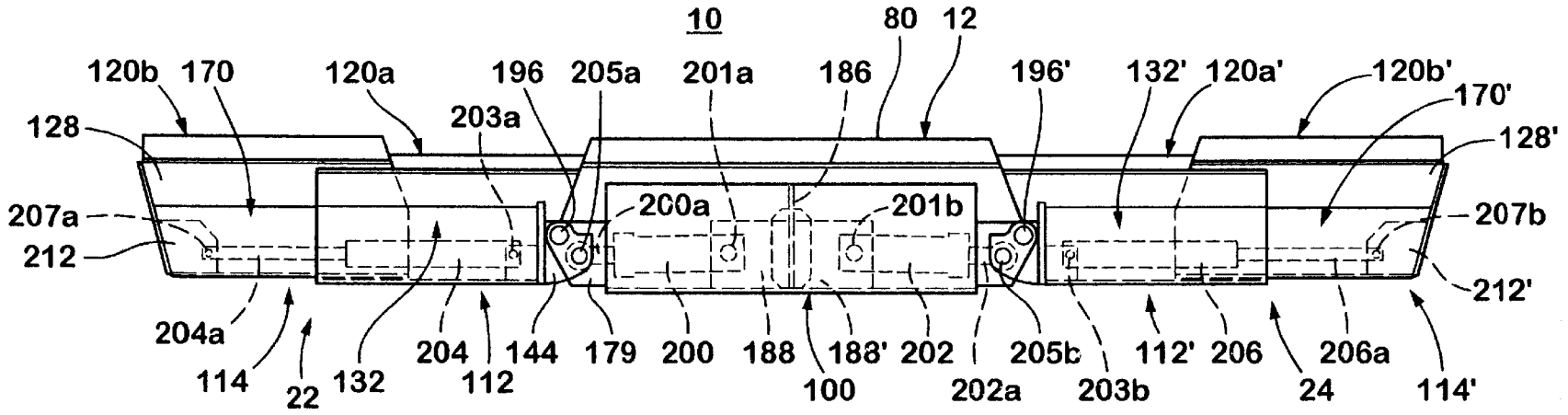
FIG. 14 is a top plan view of the plow assembly of the present invention, wherein the plow wings are extended and aligned with the plow, with the actuators shown in phantom.
Figure 17:
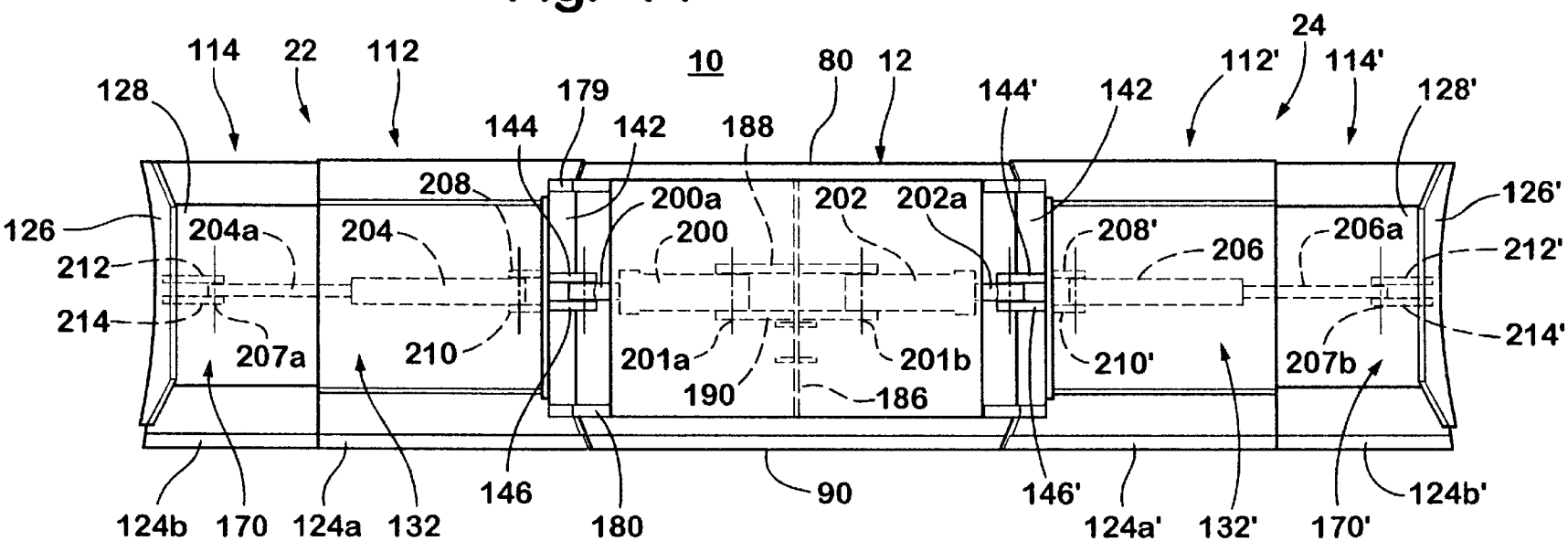
FIG. 17 is a rear elevation of the plow assembly of FIGS. 14–16, with the actuators shown in phantom.
Figure 15:
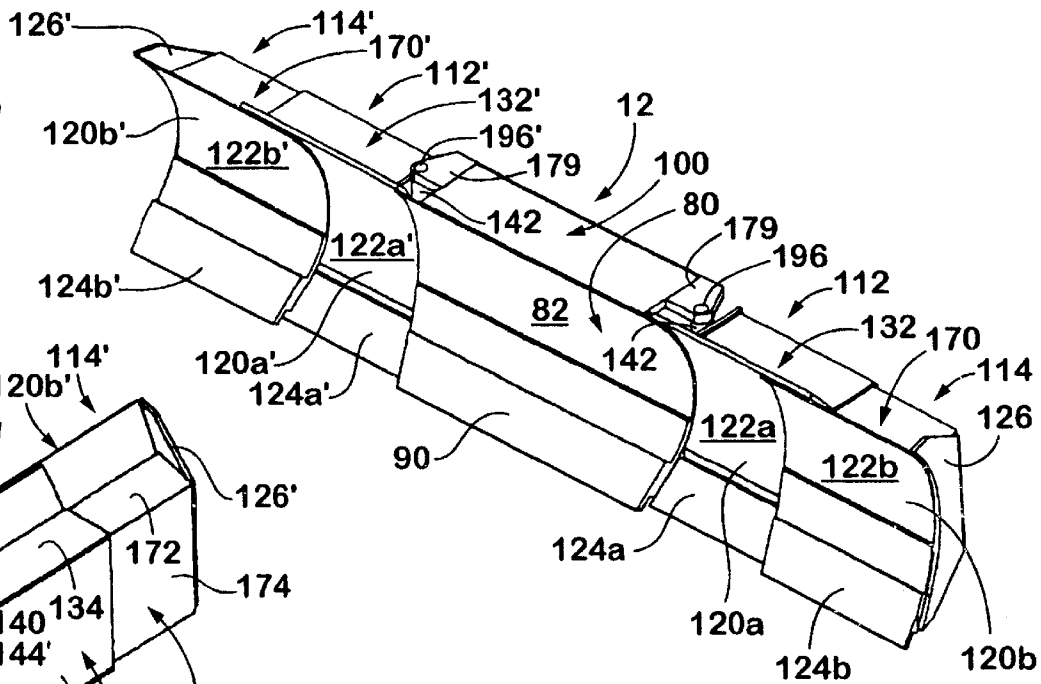
FIG. 15 is a front perspective view of the plow assembly of FIG. 14.
Figure 16:
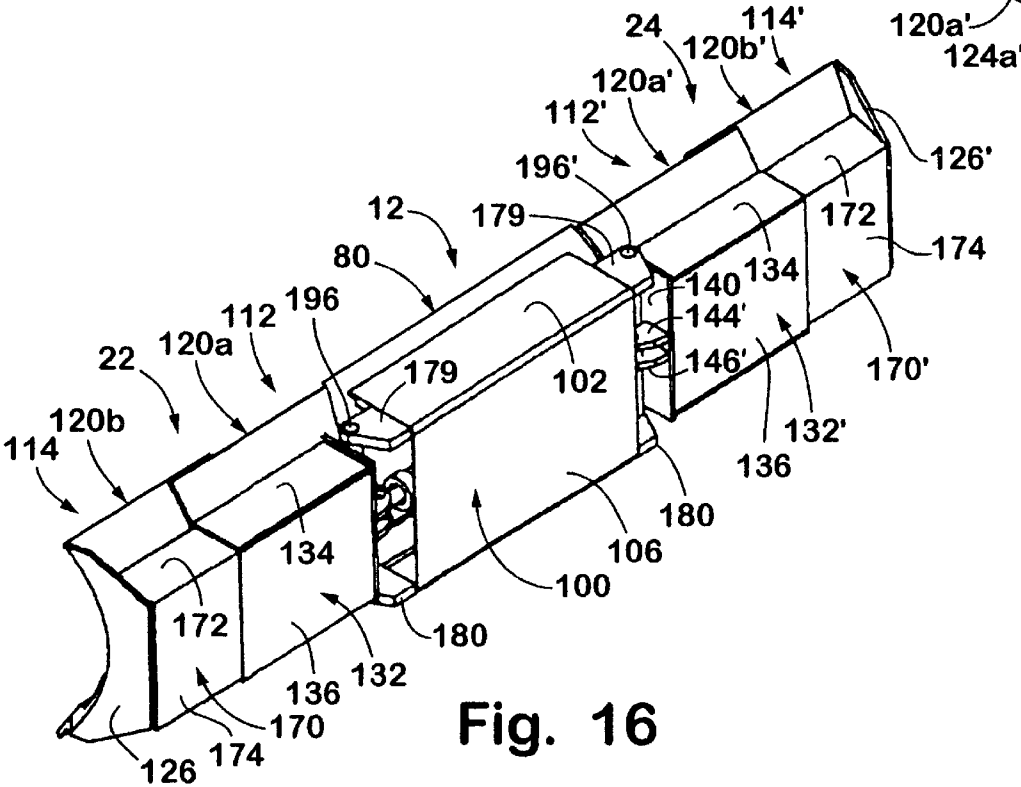
FIG. 16 is a rear perspective view of the plow assembly of FIGS. 14 and 15.
Figure 18:
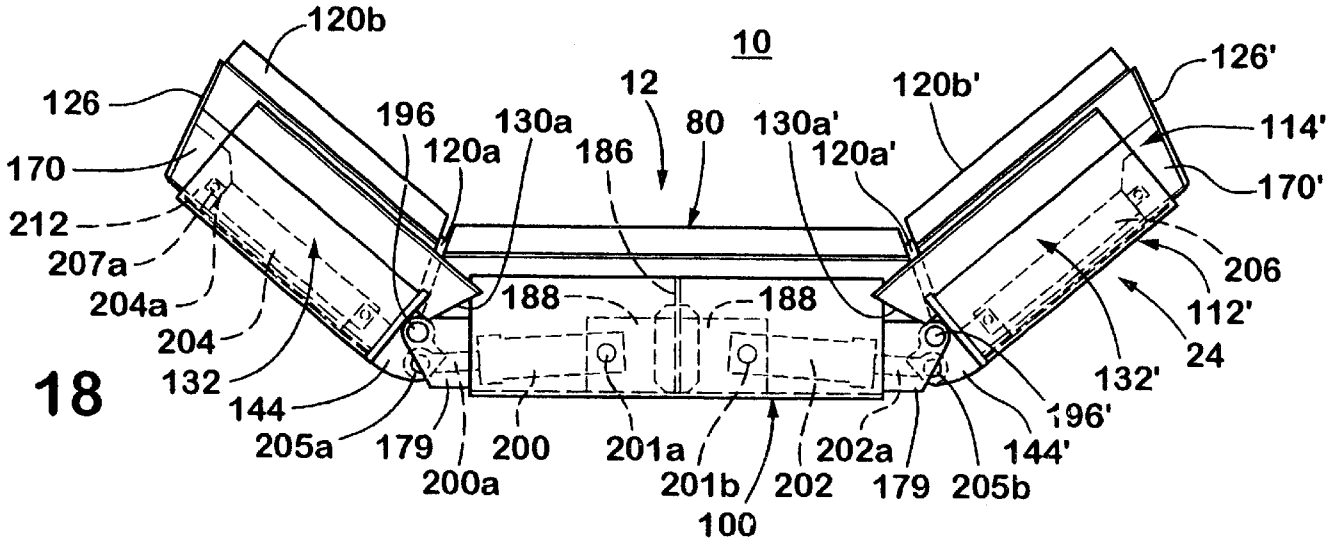
FIG. 18 is a top plan view of the plow assembly of the present invention with the plow wings angled forwardly while retracted and forming a generally U-shaped plow, with the actuators shown in phantom.
Figure 22:
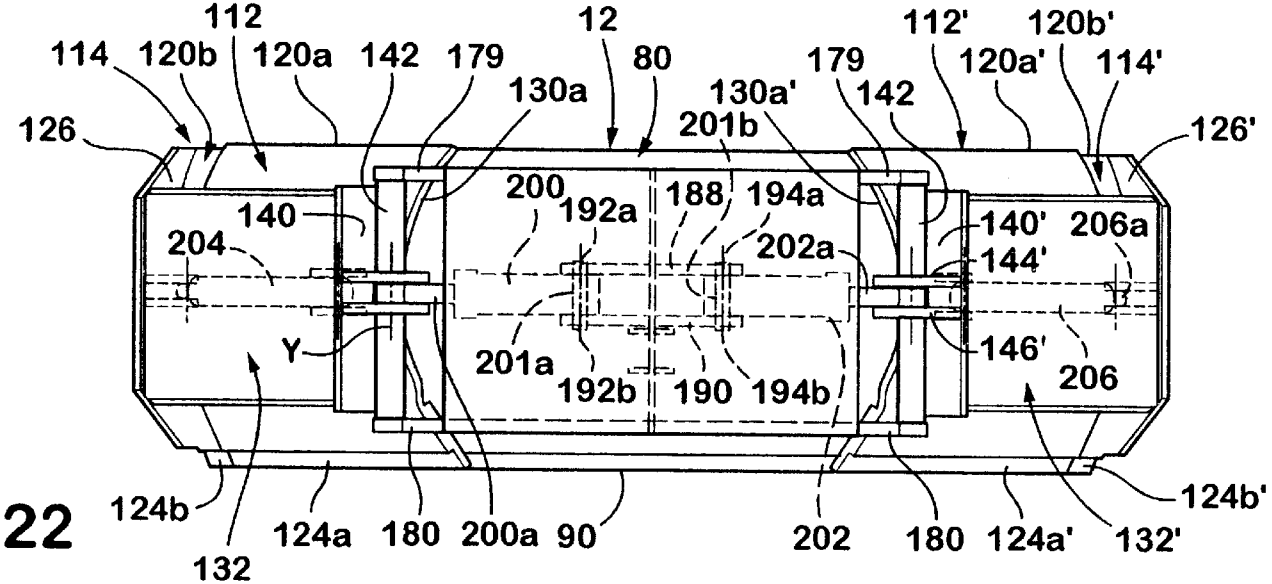
FIG. 22 is a rear elevation of the plow assembly in the configuration of FIGS. 18–21, with the actuators shown in phantom.
Figure 19:
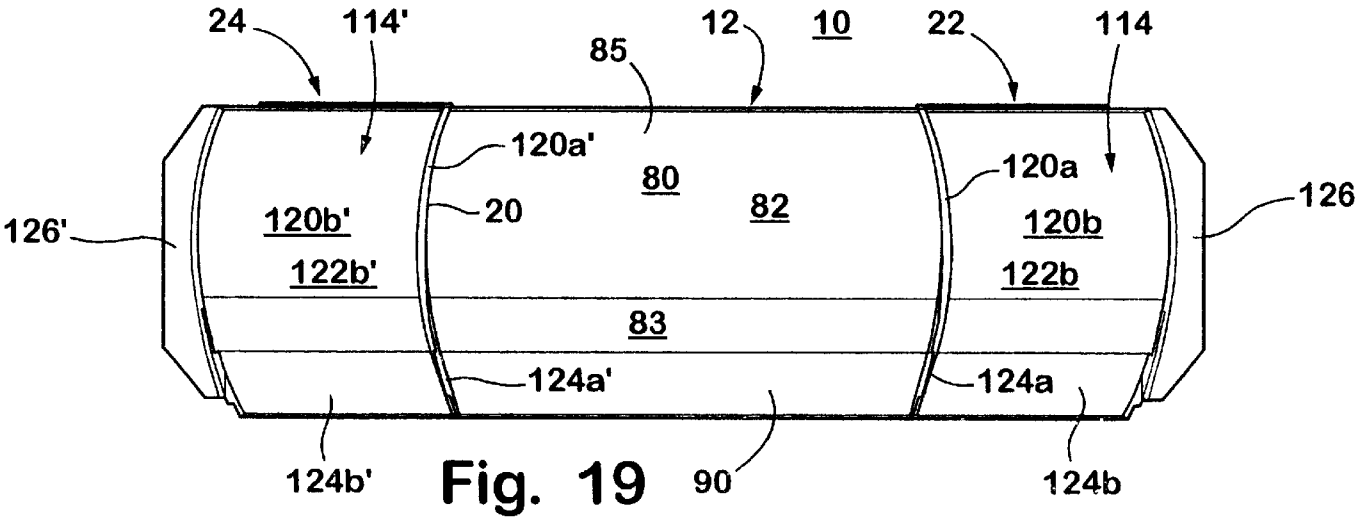
FIG. 19 is a front elevation of the plow assembly in the configuration of FIG. 18.
Figure 24:
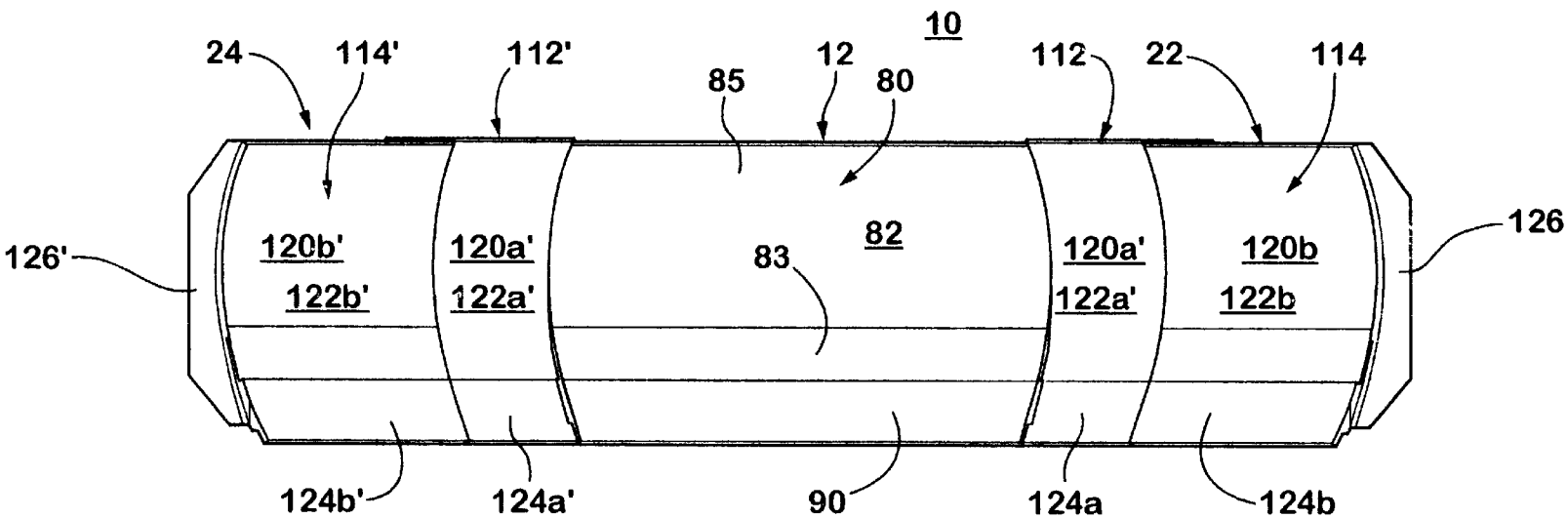
FIG. 24 is a front elevation of the plow assembly of FIG. 23.
Figure 21:
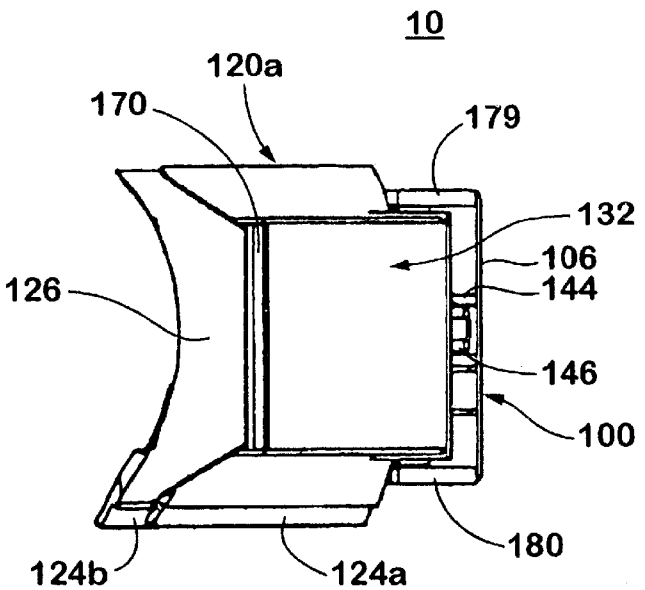
FIG. 21 is an end elevation of the plow assembly of FIGS. 18–20.
Figure 20:
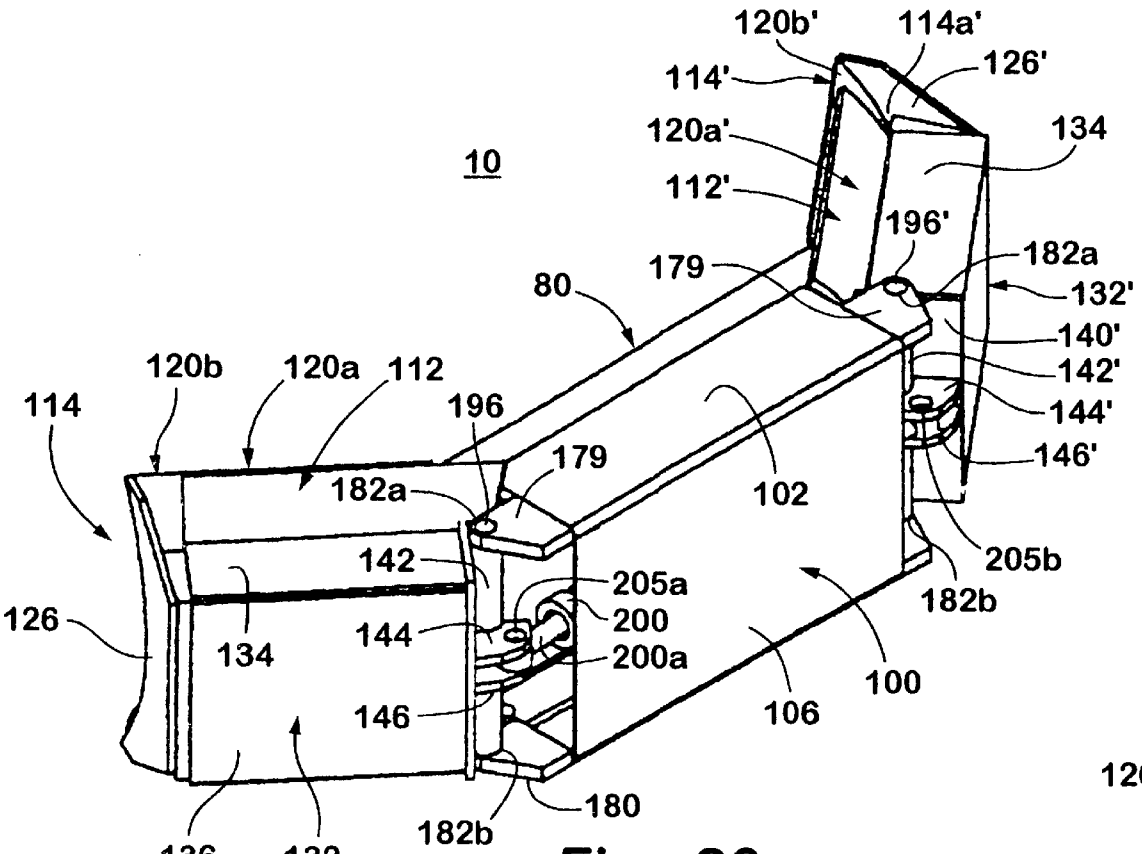
FIG. 20 is a rear perspective view of the plow assembly of FIGS. 18 and 19.
Figure 23:
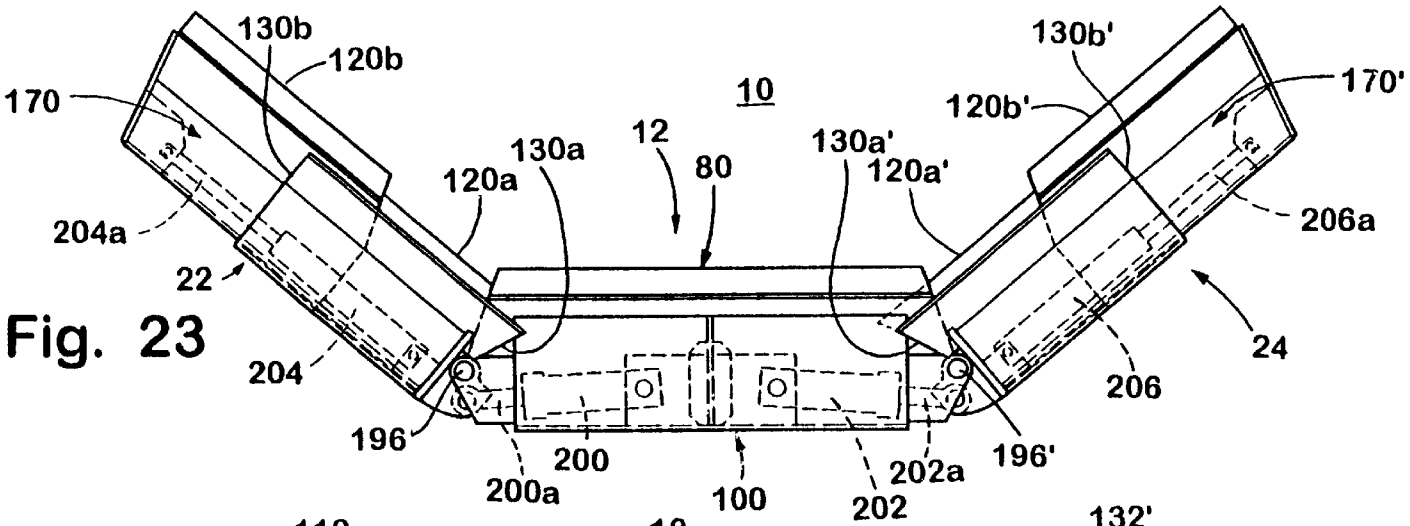
FIG. 23 is a top plan view of the plow assembly of the present invention with the plow wings extended and angled forwardly, with the actuators shown in phantom.
Figure 27:
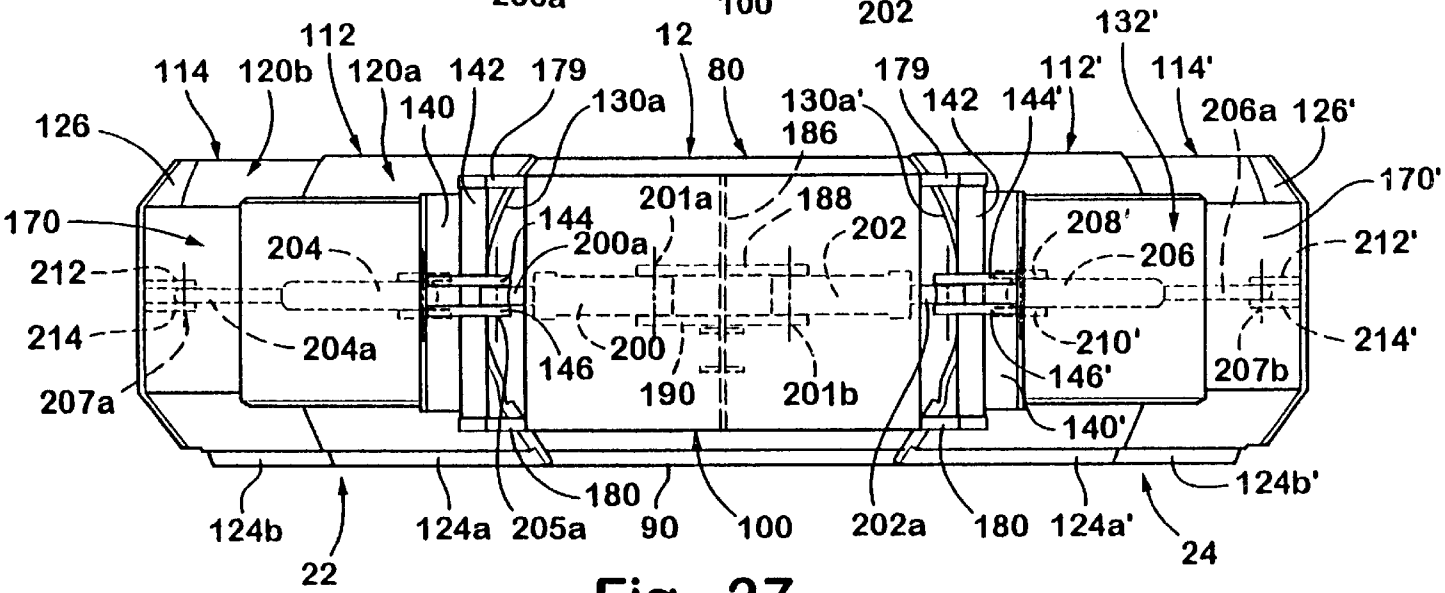
FIG. 27 is a rear elevation of the plow assembly in the configuration of FIGS. 23–26, with the actuators shown in phantom.
Figures 25, 26:
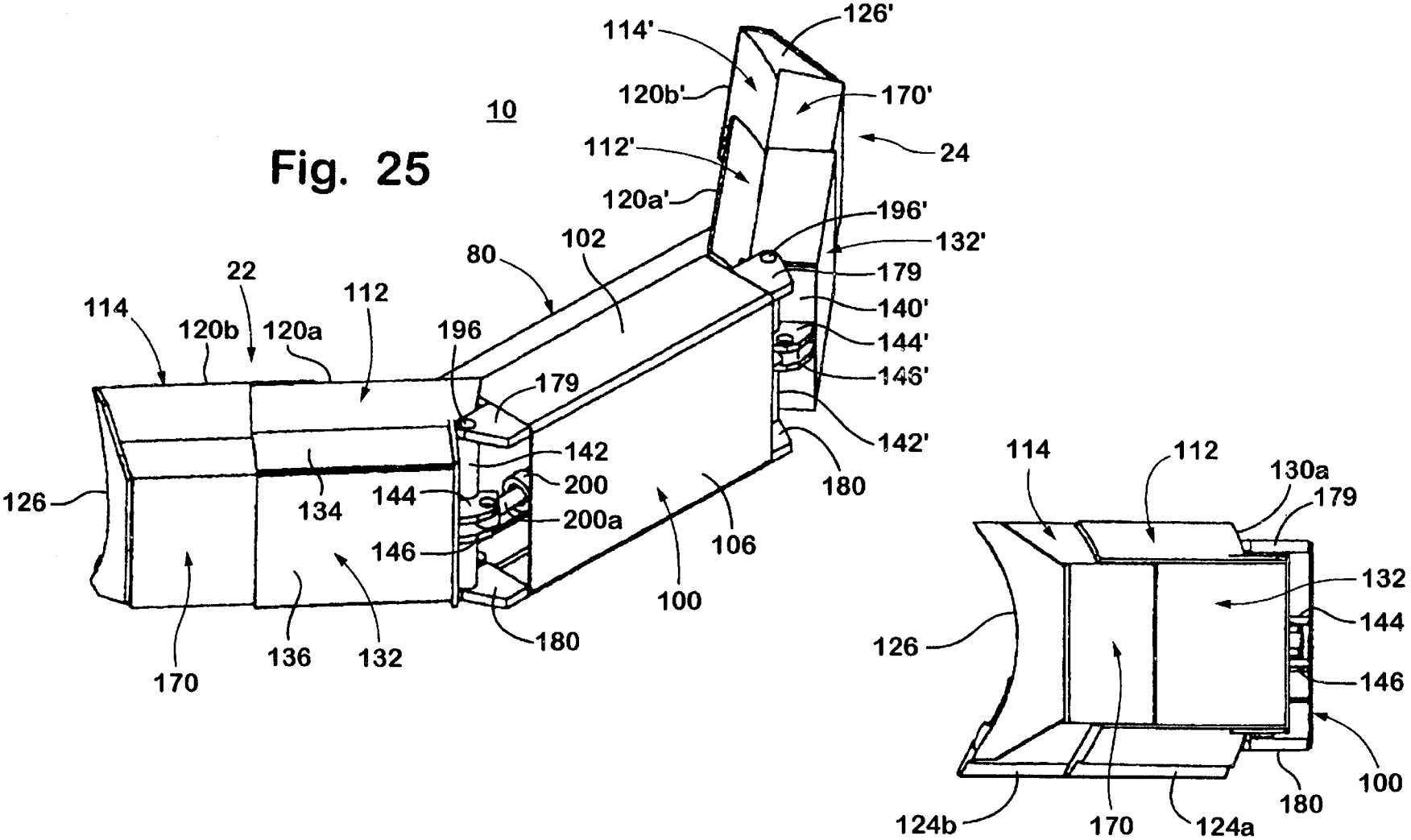
FIG. 25 is a rear perspective view of the plow assembly of FIGS. 23 and 24.
FIG. 26 is an end elevation of the plow assembly in the configuration of FIGS. 23–25.
Figure 28:
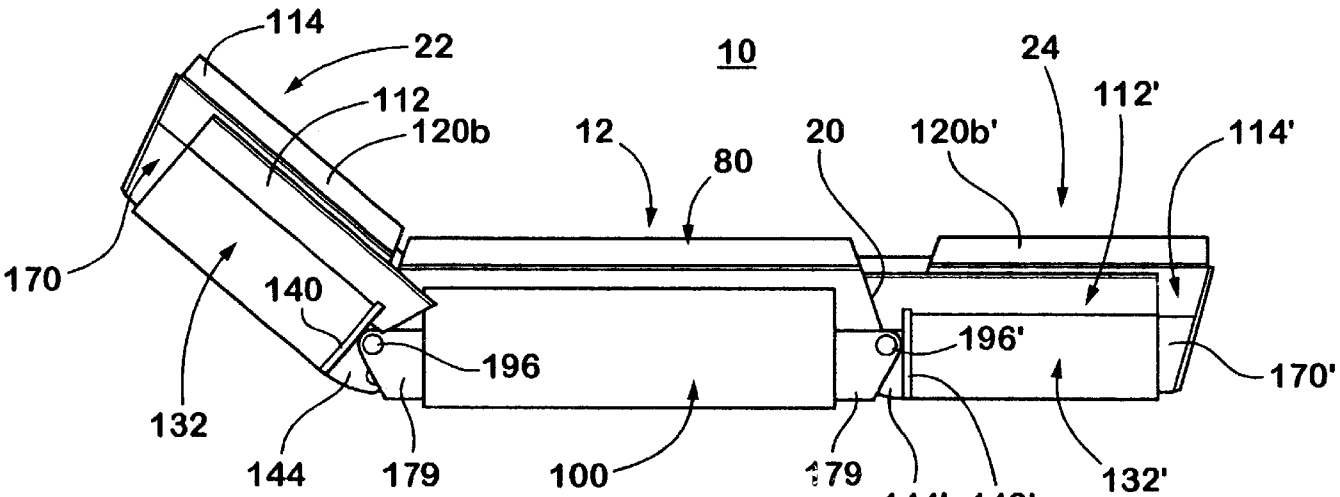
FIG. 28 is a top plan view of the plow assembly of the present invention with one plow wing angled forwardly while retracted.
Figure 29:
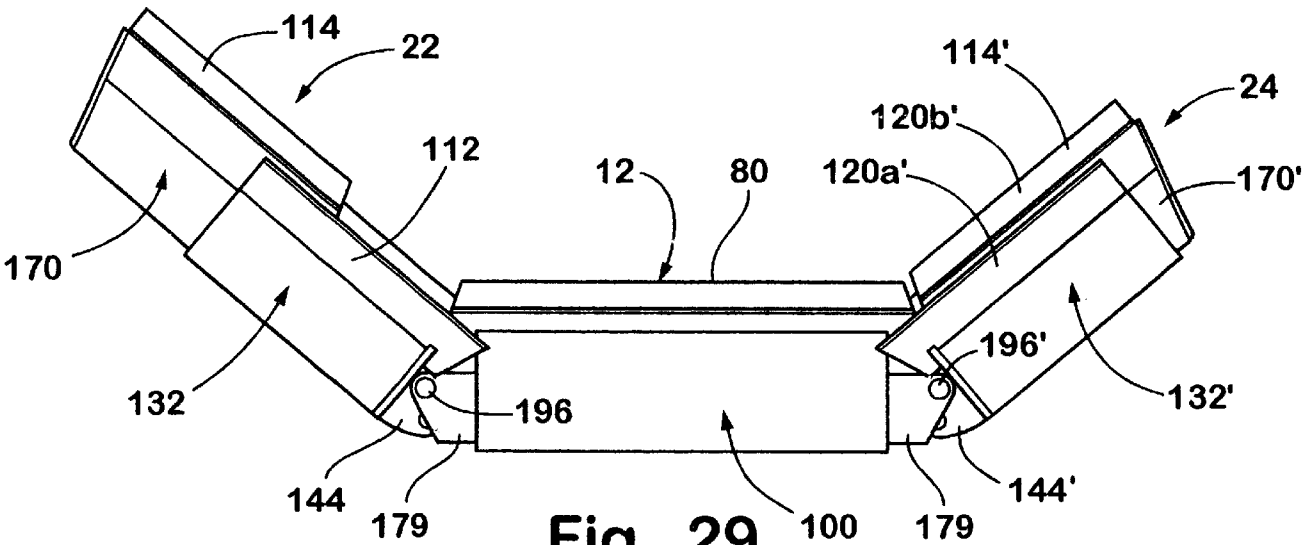
FIG. 29 is a top plan view of the plow assembly of the present invention with both plow wings angled forwardly and one of the wings also extended.

Outer portions 114, 114' of plow wings 22, 24 are mounted to the outer ends of elongated slide members 170, 170'. As shown in FIGS. 8, 10 and 13, support plate 126 at outer end 128 of moldboard 120*b* is welded or otherwise secured to an outer end 170*a* of slide member 170. A gap 114*a* is formed between moldboard 120*b* and slide member 170 (FIGS. 7, 8 and 13), such that moldboard 120*b* of outer wing portion 114 slides along a front surface of moldboard 120*a* of inner wing portion 112, while slide member 170 slides along the rear surface of moldboard 120*a* of inner wing portion 112 within or along the slide support or housing 132, such that moldboard 120*a* of inner wing portion 112 slides within and along the gap between moldboard 120*b* and slide member 170. Preferably, outer end 170*a* of slide member 170 is welded to end flange 126 along outer end 128 of moldboard 120*b*, but may be otherwise secured at outer end 128, without affecting the scope of the present invention. A pair of actuator support plates 212, 214 are welded or otherwise secured toward outer end 170*a* of slide member 170, such as at outer plate 126 (FIGS. 10 and 13), and define a pair of vertically aligned apertures 213*a*, 213*b* for mounting an end of actuator 204, thereto, as discussed below.

Figure 5:
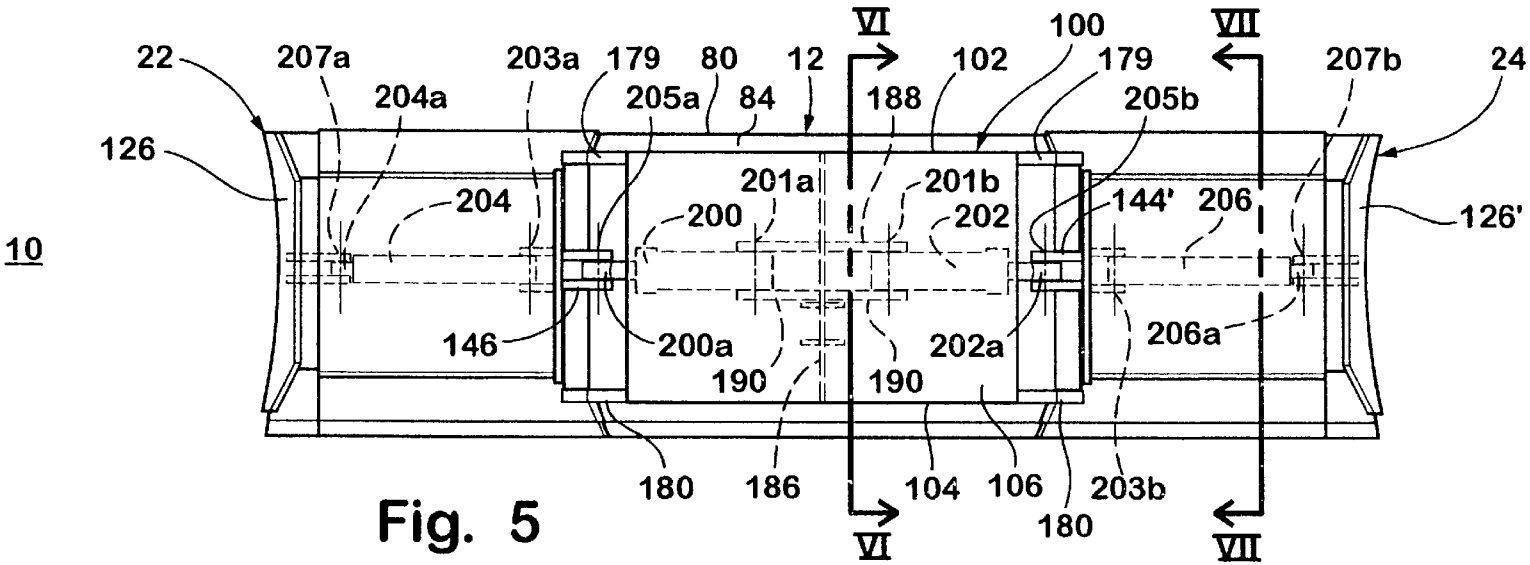
FIG. 5 is a rear elevation of the plow assembly of FIGS. 1–4, with the actuators for each of the extendable plow wings shown in phantom.
Figure 2:
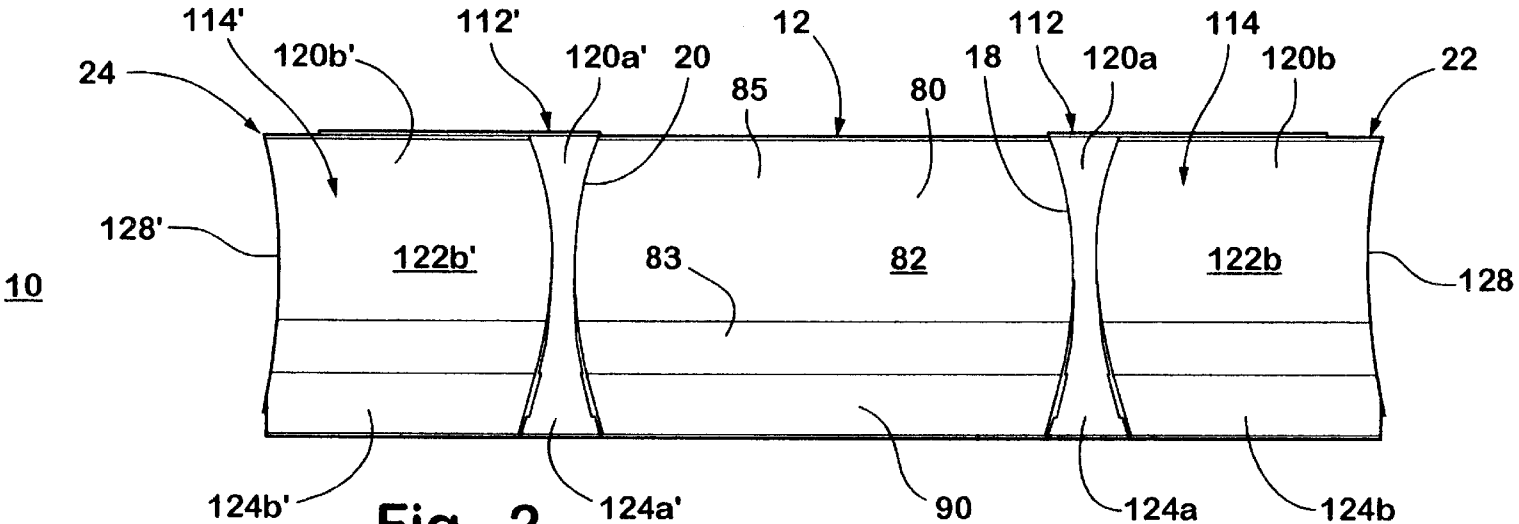
FIG. 2 is a front elevation of the plow assembly of FIG. 1.
Figure 4:
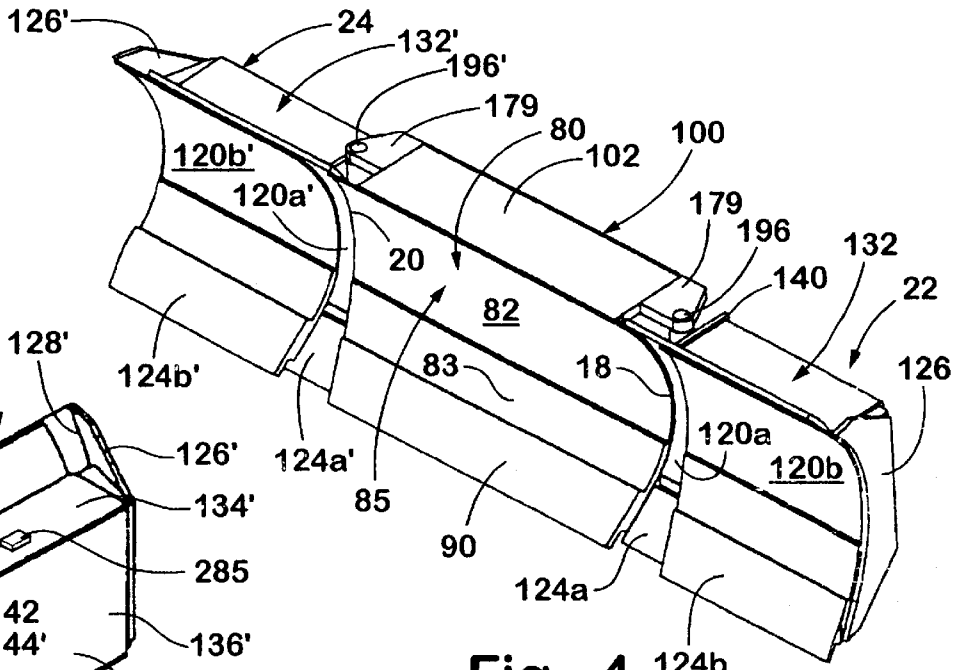
FIG. 4 is a front perspective view of the plow assembly of FIGS. 1–3.
Figure 3:
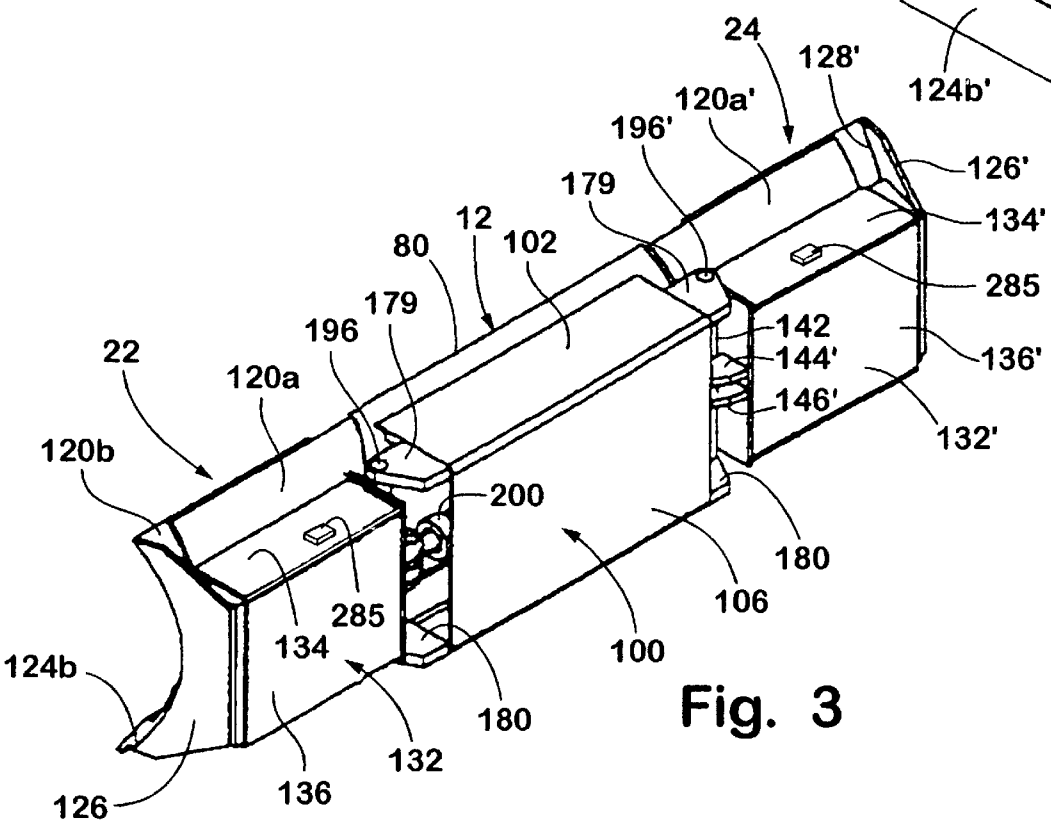
FIG. 3 is a rear perspective view of the plow assembly of FIGS. 1 and 2.

As shown in FIGS. 1 and 5, actuators 200, 202 extend into the interior space of housing 100, while actuators 204, 206 are mounted within the interior space of housings 132, 132' and extend within slide members 170, 170' to the outer end 170*a*, 170*a'* of the slide members 170, 170', for engagement therewith. A hinge pin 196 (FIGS. 1, 3, 4, 14–16, 18, 20, 25, 28 and 29) extends through vertically aligned apertures 182*a*, 182*b* and through cylindrical hinge tube 142 along axis X to provide the hinged movement between wings 22, 24 and main plow 12. Plow wing 22 therefore pivots on axis X from a position in which moldboards 120*a*, 120*b* are generally rectilinearly aligned with moldboard 80 to a forwardly angled position in which moldboards 120*a*, 120*b* extend at an obtuse angle to moldboard 80.

As best seen in FIGS. 5, 17, 22 and 27, each subassembly of a slide member 170, 170' and wing 22, 24 is preferably operated between its retracted, extended, aligned and forwardly angled positions by a pair of extendable actuators or hydraulic fluid power cylinders 200, 204 and 202, 206. Fluid cylinders 200, 202 include extendable piston rods 200*a*, 202*a* while fluid cylinders 204, 206 include extendable piston rods 204*a*, 206*a*. Fluid cylinders 204, 206 are longer and extend piston rods 204*a*, 206*a* a greater distance than fluid cylinders 200, 202 and piston rods 200*a*, 202*a*. The inner ends of fluid cylinders 200, 202 are pivotally mounted by pivot pins 201*a*, 201*b* extending between cylinder mount plates 188, 190 welded to the interior surface of housing 100 as shown in FIG. 5. One or more apertures (not shown) may be provided through rear wall 106 adjacent plates 188, 190 for access to the fluid cylinders. The outer ends of extendable piston rods 200*a*, 202*a* are pivotally secured by pivot pins 205*a*, 205*b* mounted through vertically aligned apertures 148*a*, 148*b* or 148*a*', 148*b*' in plates or mounts 144, 146 or 144', 146', respectively. Likewise, fluid cylinders 204, 206 are respectively connected via pins 203*a*, 203*b* passed through vertically aligned apertures 209*a*, 209*b* or 209*a*', 209*b*' in plates 208, 210 or 208', 210' and through the end of the fluid cylinders. The outer ends of extendable piston rods 204*a*, 206*b* are connected via pins 207*a*, 207*b* passed through the vertically aligned apertures 213*a*, 213*b* or 213*a*', 213*b*'. Accordingly, pivot pins 205*a*, 205*b* define axis Y in hinge plates 144, 146 or 144', 146'. Because of the offset between pivot axes X and Y, when fluid cylinder rods 200*a*, 202*a* are extended from cylinders 200, 202, the moment arm of the offset created by the positioning of the cylinder rods rotates plow wings 22, 24 forwardly about hinge pins 196, 196'. Fluid cylinders 200, 202, 204 and 206 act to hold and restrain the plow wings 22, 24 in the position in which they are located without the need for a latch assembly or other locking means for securing the wings in the selected position.

As best shown in FIG. 7, slide members 170, 170' are telescopingly mounted within the interior of housings 132, 132' for sliding rectilinear movement within the outer housing, while moldboards 120*b*, 120*b*' of outer wing portions 114, 114' slides along the front surfaces of moldboards 120*a*, 120*a*' of inner wing portions 112, 112'. When extension of either outer wing portion 114, 114' of wings 22, 24 is desired, the respective actuator 204, 206 is activated, such as by means of a hydraulic control system described more fully below, to extend piston rod 204*a*, 206*a*, thereby moving slide member 170 or 170' outwardly along inner wing portions 112 or 112' of wings 22 or 24. Fluid cylinder 204, 206 is operable to move slide member 170, 170' outwardly to its full extension while moldboards 120*a*, 120*b* may remain substantially parallel to the front surface of moldboard 80 of main plow 12, or while moldboards 120*a*, 120*b* are angled forwardly with respect to main plow 12. In the event it is desired to pivot one or both of the wings 22, 24 forwardly, the actuators 200 and/or 202, are activated to pivot the wings about pivot pins 196, 196', and thus about axis X, until the wings are angled forwardly, as shown in FIGS. 18–29, such that the entire plow has a U-shaped configuration. As explained below, the plow operator simply operates an appropriate switch to extend actuator 200, 202, 204 and/or 206 until the slide member is extended a desired amount and/or the wings are pivoted forwardly a desired amount. Extension and/or pivoting of the wings may be performed all in a continuous movement or motion. The hydraulic pressure in the fluid cylinders resists rearward pivoting of the forwardly angled wing extensions during plowing. In the event an obstacle is encountered, extreme pressure created within the fluid cylinders 200, 202 would be relieved through the hydraulic system to prevent rupture of hydraulic lines or damage to any of the components.

It is envisioned that outward extension of outer wing portion 114, 114' may be limited at an outermost position via a mechanical or electrical stop device. For example, rear walls 174, 174' of slidemember 170, 170' may include elongated, closed slots 215 (FIG. 10), each of which is adapted to receive a cylindrical stop member 214 (FIG. 11) projecting from housing 132, to limit the extension and retraction of the slide members, and thus, outer portions 114, 114' of plow wings 22, 24. Clearly, however, housing 132 may include a slot which receives a stop member projecting from slide member 170, without affecting the scope of the present invention. Also, cylinders 204, 206 may provide a stop member or positive stop at full extension of the cylinders 204, 206, whereby the pistons may "bottom out" within the cylinder to limit extension of the pistons and slides at a desired position. Alternately, other stop means for limiting extension of outer portion 114 with respect to inner portion 112 may be implemented, such as a spring or biasing member or the like, without affecting the scope of the present invention.

Optionally, an electronic device or switch, such as cam operated, micro switches 285 (FIG. 3), may be mounted on housing 132 to stop extension of the actuators 204, 206 and slide members 170, 170'. The micro switches may each include a flexible strap which extends through an aperture (not shown) in the housing 132 and flexes away from a plunger on an electrical switch when slide member 170, 170' is extended, but is flexed into contact with the switch plunger when the slide member is retracted. The electronic switch is operable to deactivate the respective actuator 204, 206 in response to the threshold amount of movement of the outer wing portion along the inner wing portion (corresponding to the fully extended position or fully retracted position of the plow wing). When the outer wing portion and slide reach their fully extended position, the system may be further operable (if the actuators are still actuated by the operator via an appropriate switch at the vehicle) to actuate the other actuator 200, 202 to automatically pivot the wing or wings forwardly once extended. Clearly, other stop members or limit switches may be implemented which deactuate one actuator and subsequently or substantially simultaneously actuate the other actuator, such that the plow wings are smoothly and continuously movable between their retracted, aligned positions and extended, forwardly angled positions, without affecting the scope of the present invention. As actuators 204, 206 are operated to extend rods 204*a*, 206*a*, slide members 170, 170' are moved rectilinearly outwardly until the stops engage the inner ends of the slots or otherwise stop further outward extension of the plow wings. In the extended positions, as shown in FIGS. 14–17, the outer ends 128, 128' of outer portions 114, 114' are spaced outwardly of the outer ends 130*b*, 130*b*' of inner portions 112, 112' of plow wings 22, 24, respectively, and, thus, outwardly of the retracted positions of outer portions 114, 114'.

As shown in FIG. 30, each fluid cylinder 200, 202, 204 and 206 is controlled by its own solenoid operated hydraulic valve and cooperating hydraulic relief valve via electrical switches mounted in the cab of the plowing vehicle. A conventional hydraulic pump 250 creates hydraulic line pressure which is directed by an electric solenoid operated spool valve 252*a* or 252*b* through line 254*a* or 254*b* to the inner end of fluid cylinder 200 or 202, thereby extending piston rod 200*a* or 202*b* upon closure of an appropriate electrical switch in the vehicle cab by the vehicle/plow operator. This shifts solenoid valve 252*a* or 252*b* to the left or right, respectively, in FIG. 30, and causes plow wings 22, 24 to pivot forwardly about pivots 196, 196'. Also, a switch may be actuated to actuate solenoid valve 253*a* or 253*b* to pressurize line 258*a* or 258*b* to fluid cylinder 204 or 206, causing extension of piston 204*a* or 206*a* and thereby extending outer wing portion 114, 114' of wings 22 or 24. It is envisioned that various controls or solenoid valves may be interconnected with the actuators such that the plow operator need only depress a single switch to cause fluid pressure to extend cylinder 200 and/or 202 and then subsequently cylinder 204 and/or 206 such that the wings are first pivoted forwardly and then extended in one continuous motion. Alternately, the wings may first be extended and then angled forwardly in a continuous motion via actuation of one or more switches. Preferably, the solenoid valves are independently actuable to allow independent extension and pivoting of each wing. Release of the switch or switches causes solenoid valves 252*a*, 252*b* and/or 253*a*, 253*b* to return to their centered positions thereby holding fluid cylinders 200, 202, and/or 204, 206 in their extended positions.

When return of wing extensions 22, 24 to their non angled or aligned positions and retraction of slide members 170, 170' is desired, however, solenoid valve 252*a* or 252*b* is activated in the reverse direction by moving or depressing the appropriate electrical switch shifting the spool valve to the right or left, respectively, in FIG. 30. Hydraulic pressure is directed through lines 260*a*, 260*b* to the outer end of fluid cylinder 200 or 202, causing retraction of piston rod 200*a* or 202*a* and pivoting wing 22 or 24 to its non-pivoted position from its forwardly angled position. Actuation of another switch likewise directs hydraulic pressure through lines 264*a*, 264*b* via solenoid valves 253*a*, 253*b* to the outer end of fluid cylinders 204, 206, causing retraction of piston rods 204*a*, 206*a* and hence, slide members 170, 170' and outer wing portions 114, 114' of wings 22, 24. Again, sequential retraction of the piston rods in the fluid cylinders may occur continuously without the necessity of the operator throwing separate switches if so desired.

As shown in FIG. 30, valving for operating the fluid cylinders 42, 44 to pivot the plow assembly about support 14 and axis 62 to the left or right is provided through solenoid operated valve 266 which is shifted to the right by operation of an electrical switch to angle the plow assembly to the left with fluid cylinder 42 through hydraulic line 270*a*, and shifted to the right through the reversal of the same switch to angle the plow assembly to the right with fluid cylinder 44 through hydraulic line 270*b*. Appropriate relief valves 272, 274 are connected, respectively, to lines 270*a*, 270*b* in the event pressure on the plow during plowing forces the plow in the opposite pivotal direction and creates extreme pressure within the hydraulic system.

Likewise, a solenoid operated valve 276 and an electrically operated check valve 278 may be shifted to the left to activate and extend the lift cylinder 76 in the event such a cylinder is included on the support 14. Check valve 279 retains cylinder 76 in its extended position. Similarly, to retract cylinder 76, solenoid operated valve 277 and check valve 279 are shifted to the left, and check valve 278 holds cylinder 76 in its retracted position.

Figure 31:
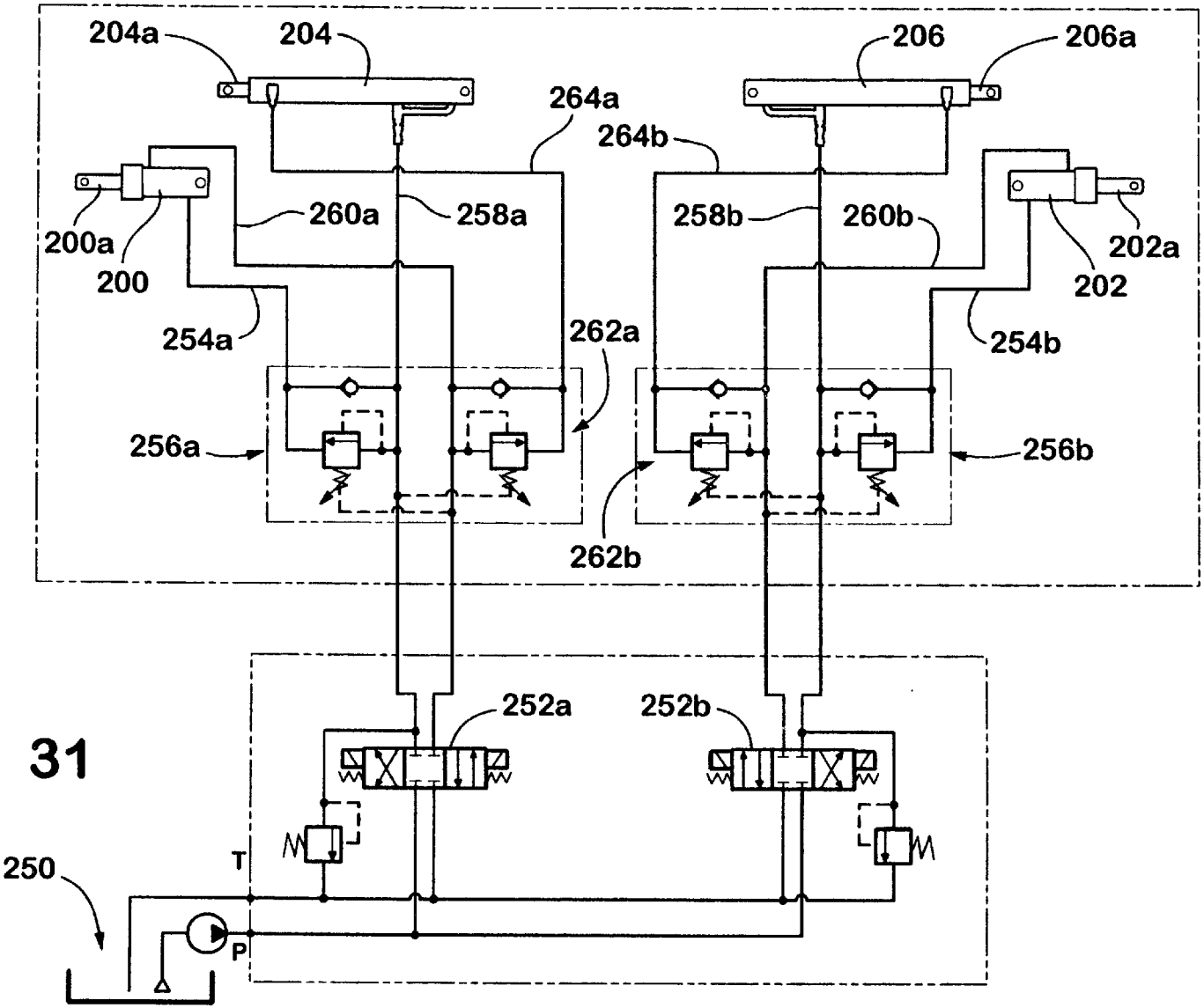
FIG. 31 is a schematic illustration of an alternate hydraulic system for operation of the adjustable plow assembly of the present invention.

Alternately, actuators 200, 202, 204 and 206 may be controlled via the solenoid valves as shown in FIG. 31. The controls of actuators 42, 44 and 76 for this control system are the same as shown in FIG. 30 and discussed above, and are thus not included in FIG. 31 and discussed again herein. As shown in FIG. 31, each pair of fluid cylinders 200, 204 or 202, 206 is controlled by its own respective set of solenoid operated hydraulic valves and cooperating hydraulic relief valves via electrical switches mounted in the cab of the plowing vehicle. A conventional hydraulic pump 250 again creates hydraulic line pressure which is directed by an electric solenoid operated spool valve 252*a* or 252*b* through line 258*a* or 258*b* to the inner end of fluid cylinder 204 or 206, thereby extending piston rod 204*a* or 206*a* upon closure of an appropriate electrical switch in the vehicle cab by the vehicle/plow operator. This shifts solenoid valve 252*a* or 252*b* to the left or right, respectively, in FIG. 31. Once piston rod 204*a* or 206*a* is fully extended, and the plow wing is thus fully extended, the buildup of hydraulic pressure in line 258*a* or 258*b* activates an hydraulic relief valve or sequencing valve 256*a* or 256*b* to allow fluid pressure through hydraulic line 254*a* or 254*b* to fluid cylinder 200 or 202, causing extension of piston 200*a* or 202*a*, and thereby pivoting wings 22 or 24. Thus, the plow operator need only depress a single switch causing fluid pressure to extend cylinder 204 or 206 and then subsequently cylinder 200 or 202 through the operation of relief valves 256*a*, 256*b*. Release of the switch causes solenoid valves 252*a*, 252*b* to return to their centered positions thereby holding fluid cylinders 200, 204, and/or 202, 206 in their extended and forwardly pivoted positions. If desired, electronic switches, such as cam operated micro switches 285, may be mounted on the housing 132 to stop extension of the cylinders 204, 206 and slide members 170, 170', followed by activation of a separate switch to cause extension of cylinders 200, 202, and thus forward pivoting of the wings, as discussed above.

When return of wings 22, 24 to their non-extended and aligned positions is desired, however, solenoid valve 252*a* or 252*b* is activated in the reverse direction by moving or depressing the appropriate electrical switch and thus shifting the spool valve 252*a*, 252*b* to the right or left, respectively, in FIG. 31. Hydraulic pressure is directed through lines 260*a*, 260*b* to the outer end of fluid cylinder 200 or 202 causing retraction of piston rod 200*a* or 202*a* and pivoting wings 22, 24 from their forwardly angled position to their aligned position. When piston rod 200*a*, 202*a* is fully retracted, increased hydraulic pressure in line 260*a*, 260*b* is directed through an hydraulic relief valve or sequencing valve 262*a*, 262*b* and lines 264*a*, 264*b* to the outer end of fluid cylinders 204, 206, causing retraction of piston rods 204*a*, 206*a* and hence, retracting slide members 170, 170' and thus outer wing portions 114, 114' of wings 22, 24, such that the wings are retracted, as shown, for example, in FIGS. 1–5. Again, such sequential retraction of the piston rods in the fluid cylinders occurs continuously without the necessity of the operator throwing separate switches through the operation of the relief valves 262*a*, 262*b*.

It is further envisioned that the control system of the present invention may operate in a reverse manner from the system shown in FIG. 31 and discussed above, without affecting the scope of the present invention. More particularly, the solenoid valves and relief valves may be operable to first extend hydraulic cylinders 200, 202 to first pivot the wings to their forwardly angled position. After the wings are pivoted to their fully angled positions, the relief valve may direct pressure to hydraulic cylinders 204, 206, in order to extend the outer wing portions 114, 114' of wings 22, 24, while the wings are in the aligned position. As discussed above, the return of the plow wings to their initial, retracted and aligned orientation is accomplished in a reverse manner, with the outer wing portions first retracting to their pivoted and retracted position via retraction of cylinders 204, 206, and then being pivoted via retraction of cylinders 200, 202 to their aligned and retracted position.

Additionally, it is envisioned that the control system of the plow assembly may be selectably operable via one or more switches to pivot the wings first and then extend the outer wing portion, (as described above) and/or to extend the outer wing portions first and then pivot the wings (as shown in FIG. 31 and described above). The operator would selectively actuate a single switch to provide smooth continuous extension and pivoting of the wings in the desired sequence.

Although shown and described as a pair of hydraulic fluid cylinders, a single actuator may be implemented which is operable to sequentially extend then pivot or pivot then extend one or both wings. For example, the actuator may be an extendable and retractable, double acting actuator or hydraulic cylinder mounted at an outer end of the outer wing portion, with its rod end mounted at the pivot axis Y. Optionally, the plow assembly may include a spring or biasing member (not shown) which is connected between the plow 12 and one of the wing portions. The spring may then be operable to limit or restrain pivotal movement of the respective wing until after the wing is extended, at which point the biasing force of the spring may be overcome by further extension of the actuator. The spring may also be biased to hold the wings in their aligned position. This provides protection for the hydraulic system, since the wings can pivot forwardly in response to an encounter with an obstacle when the plow is traveling in reverse, whereby the shock and forces exerted by the obstacle are absorbed by the spring or springs and not by the actuators 200, 202. Alternately, the spring biased device, or other limit or stop member or device, may function to limit or restrict extension of the wing until after the wing is pivoted to its forwardly angled position. Other double acting, single actuators may be implemented to sequentially pivot and extend the plow wing or wings in a desired manner, without affecting the scope of the present invention.

Although shown and described as hydraulic fluid cylinders with extendable and retractable rods, the actuators for the plow assembly of the present invention, whether a pair of actuators for each plow wing or a single actuator for one or both plow wings, may comprise other means for extending and retracting or for pivoting. For example, the actuators 200, 202 may comprise an electronic or hydraulic rotary motor or other means for imparting relative rotation between two components about a hinge or pivot axis. Additionally, the actuators 200, 202, 204 and/or 206 may comprise a linear actuator with a ball and screw mechanism, or may comprise an electronic or hydraulic rotary motor with a gear which engages a timing belt or other toothed, movable member, such that rotation of the motor imparts a generally linear movement of the movable member, thereby extending or pivoting the plow wings. It is further envisioned that the actuators may even be manually operated mechanical devices, such as a hand crank or lever, which may be operable to impart a linear or rotational movement to the plow wing. Other means for imparting a linear or rotational movement may be implemented without affecting the scope of the present invention. It is further envisioned that one or two actuators may be operable to first extend and then pivot one or both of the wings or to first pivot and then extend the wings, without affecting the scope of the present invention. In situations where an hydraulic cylinder is not implemented, an additional stop or locking mechanism (not shown) may be desired to lock or retain the plow wings in the desired position, such that the wings are not pivoted when resistance is encountered by the plow as it is moved by the vehicle.

As will also be appreciated, it is also possible to support the plow assembly including main plow 12 and plow wings 22, 24 on a support other than support frame 14 and intermediate support 16 at the front of a vehicle. For example, should the plow be used on a grader, an overhead beam may include downwardly extending rods or other supports which engage rear mounting flanges 54, 56 from above to support the assembly in the normal horizontal position shown in the drawings. Other supports, such as bulldozer type, generally horizontal support arms extending from the rear of the plow to a support frame on a vehicle, may also be used with this plow assembly, without affecting the scope of the present invention.

Therefore, the present invention provides a plow assembly with wings which are adjustable between a retracted and aligned position and an extended and forwardly angled position. The wings may first be pivoted forwardly and then extended/retracted to adjust the carrying capacity of the U-shaped plow. This may be desirable depending on the type and consistency of the material being plowed. For example, in light or loose material, the plow wings may be extended to increase the carrying capacity of the blade and thereby increase the efficiency of the plow. Also, when the plow encounters heavy material, the operator may retract the wings to reduce the carrying capacity of the plow to an amount which the dozer or vehicle can effectively handle. The front, material engaging surfaces of the plow and plow wings are generally continuous and uninterrupted.

Additionally, the plow wings may be independently pivoted and/or extended as desired by the operator. Optionally, the actuators may be operable to first pivot or extend the wings and then extend or pivot the wings, respectively, such that the wings are moved from the aligned and retracted position to the forwardly angled and extended position in a generally continuous and uninterrupted motion. The wings may be movable or pivotable first in response to a stop member limiting pivotal movement or extension until after the wings have been fully extended or pivoted, respectively. Alternately, two actuators may be sequentially operable to extend then pivot or to pivot then extend the wings in response to a limit switch, which determines when the wings have fully extended or pivoted and deactuates the first actuator and subsequently or generally simultaneously actuates the second actuator, or at least one pressure relief or sequencing valve interconnected with the actuators, which restricts extension or retraction of one of the actuators until after the other actuator has been fully extended or retracted.

While several forms of the invention have been shown and described, other forms will now be apparent to those skilled in the art. Therefore, it will be understood that the embodiments shown in the drawings and described above are merely for illustrative purposes, and are not intended to limit the scope of the invention which is defined by the claims which follow as interpreted according to the principles of patent law, including the Doctrine of Equivalents.

The embodiments of the invention in which an exclusive property or privilege is claimed are defined as follows:

1. A plow assembly for vehicles, said assembly comprising:

a plow having first and second ends, a front material engaging surface, and a rear surface opposite said front surface, said plow having a hinge member at said first end;

a support for attaching said plow to the vehicle;

an extendable plow wing pivotally mounted at said hinge member, said plow wing having an inner portion pivotally mounted at said hinge member and an outer portion slidably mounted to said inner portion, each of said inner and outer portions having a moldboard which includes a front material engaging surface and a rear surface opposite said front surface;

said outer portion of said plow wing being mounted for sliding movement along said inner portion between a retracted position in which an outer end of said outer portion is adjacent an outer end of said inner portion, and an extended position in which said outer end of said outer portion is spaced outwardly of said retracted position;

said inner portion of said plow wing being pivotally mounted on said hinge member for movement between an aligned position in which said front surface of said inner and outer portions of said plow wing are generally aligned with said front surface of said plow, and a forwardly angled position in which said front surfaces of said plow wing extend at an angle to said front surface of said plow; and at least one actuator connected to said plow wing, said at least one actuator being operable to move said outer portion between said retracted and said extended positions, and to move said plow wing between said aligned position and said forwardly angled position.

2. The plow assembly of claim 1 including a slide which is movable along said rear surface of said inner portion of said plow wing, said outer portion of said plow wing being mounted on and movable with said slide.

3. The plow assembly of claim 2, wherein said slide is movably mounted to a slide support at said rear surface of said inner portion of said plow wing.

4. The plow assembly of claim 2, wherein said slide is telescopically mounted within a housing on said rear surface of said inner portion, said outer portion of said plow wing being mounted to said slide at said outer end of said outer portion.

5. The plow assembly of claim 4, wherein said moldboard of said outer portion of said plow wing is slidable along said front surface of said inner portion of said plow wing.

6. The plow assembly of claim 4, wherein, said slide is spaced from said rear surface of said moldboard of said outer portion of said plow wing, said moldboard of said inner portion being slidably positioned between said slide and said rear surface of said moldboard of said outer portion.

7. The plow assembly of claim 2, wherein said at least one actuator comprises a first actuator and a second actuator, said first actuator being operable to move said slide to move said outer portion of said plow wing between said extended and retracted positions, said second actuator being operable to pivot said plow wing about said hinge member to move said plow wing between said aligned and angled positions.

8. The plow assembly of claim 7, wherein each of said first and second actuators has two ends, one end of said first actuator being pivotally connected to said rear surface of said inner portion of said plow wing, the other end of said first actuator being pivotally connected to said slide, one end of said second actuator being pivotally connected to said rear surface of said plow, the other end of said second actuator being pivotally connected to said hinge member.

9. The plow assembly of claim 8, wherein said hinge is pivotally connected to said inner portion of said plow wing along a generally vertical pivot axis, said other end of said second actuator being pivotally connected to said hinge member at a distance from said vertical pivot axis.

10. The plow assembly of claim 8, wherein said first actuator has a first length and has a first extendable member pivotally connected to said slide and adapted to extend and retract a first distance for movement of said slide a distance corresponding to said first distance, said second actuator having a second length which is less than said first length and having a second extendable member pivotally connected to said hinge member and adapted to extend and retract a second distance which is less than said first distance for pivotal movement of said plow wing about said generally vertical pivot axis.

11. The plow assembly of claim 7, wherein said first and second actuators are operable to move said plow wing from said aligned position and said retracted position to said extended position and said forwardly angled position via a smooth, continuous movement of said plow wing.

12. The plow assembly of claim 11, wherein said plow wing is movable from said aligned and retracted position to said extended and forwardly angled position via at least one sequencing valve interconnected with said first and second actuators.

13. The plow assembly of claim 11, wherein said first and second actuators are operable to first move said plow wing from said aligned position to said forwardly angled position and then to move said outer portion of said plow wing from said retracted position to said extended position.

14. The plow assembly of claim 11, wherein said first and second actuators are operable to first move said outer portion of said plow wing from said retracted position to said extended position and then to move said plow wing from said aligned position to said forwardly angled position.

15. The plow assembly of claim 1, further including at least one stop member which limits movement of said outer portion of said plow wing along said inner portion of said plow wing.

16. The plow assembly of claim 1, wherein the vehicle has a longitudinal axis generally aligned with the direction of motion of the vehicle when traveling in forward or reverse, said support including a support frame for attaching said plow to the front of the vehicle, said plow being pivotally mounted on said support frame for movement about a first, generally vertical pivot axis from a centered position extending generally transverse to the longitudinal axis of the vehicle to a series of angled positions in which said plow is angled to the left or right of said centered position.

17. The plow assembly of claim 16, wherein said plow is pivotally connected to said support frame about a second, generally horizontal pivot axis to allow forward pivotal movement of said plow and plow wing in unison when at least one of said plow and plow wing encounter an obstacle during plowing.

18. The plow assembly of claim 1, wherein said front surface of said plow and said front surface of said outer portion of said plow wing are generally aligned with one another in said aligned position, said front surface of said inner portion of said plow wing being positioned at least partially behind said front surface of said plow and said front surface of said outer portion in said aligned position.

19. The plow assembly of claim 1, wherein said front surface of said plow and said front surfaces of said inner and outer portions of said plow wing are generally continuous and uninterrupted surfaces.

20. The plow assembly of claim 1 including a second plow wing at a second hinge member at said second end of said plow, said second plow wing having an inner portion pivotally mounted at said second hinge member and an outer portion slidably mounted to said inner portion of said second plow wing, each of said inner and outer portions of said second plow wing including a moldboard having a front material engaging surface and a rear surface, said outer portion of said second plow wing being mounted for sliding movement along said inner portion of said second plow wing between a retracted position in which an outer end of said outer portion of said second plow wing is adjacent an outer end of said inner portion of said second plow wing and an extended position in which said outer end of said outer portion of said second plow wing is spaced outwardly of said retracted position of said second plow wing, said second plow wing being pivotally mounted on said second hinge member for movement between an aligned position in which said front surface of said inner and outer portions of said second plow wing are generally aligned with said front surface of said plow, and a forwardly angled position in which said front surface of said second plow wing extends at an angle to said plow front surface.

21. The plow assembly of claim 20, wherein said at least one actuator comprises at least two actuators, at least one of said actuators being connected to said second plow wing and being operable to move said second plow wing between its retracted and its extended positions and being further operable to move said second plow wing between said extended position and said forwardly angled positions.

22. The plow assembly of claim 21 including a first slide and a second slide, said first slide being movably mounted on said inner portion of said first plow wing, said second slide being movably mounted on said inner portion of said second plow wing, said outer portion of said first plow wing being mounted on and movable with said first slide, said outer portion of said second plow wing being mounted on and movable with said second slide.

23. The plow assembly of claim 22, wherein said first and second slides are telescopically mounted within at least one housing on said rear surface of said inner portions of said first and second plow wings, said outer portions of said plow wings being mounted on said slides at said outer end of said outer portions.

24. The plow assembly of claim 23, wherein said moldboard of said outer portion of each of said plow wings is slidable along said front surface of a respective inner portion of said plow wings.

25. The plow assembly of claim 23, wherein said slide and second slide are spaced from said rear surface of said moldboard of a respective one of said outer portions of said plow wing and said second plow wing, said moldboard of said inner portions being slidably positioned between a respective one of said first and second slides and said rear surface of said moldboards of a respective one of said outer portions.

26. The plow assembly of claim 22, wherein said at least two actuators includes first, second, third and fourth actuators, said first actuator being operable to move said first slide and said outer portion of said plow wing between said extended and retracted positions, said second actuator being operable to move said plow wing between said aligned and angled positions, said third actuator being operable to move said second slide and said outer portion of said second plow wing between said extended and retracted positions, said fourth actuator being operable to move said second plow wing between said aligned and angled positions.

27. The plow assembly of claim 26, wherein each of said actuators has two ends, one end of said first and third actuators being pivotally connected to said rear surface of said inner portion of said first and second plow wings, the other end of said first actuator being pivotally connected to said first slide, the other end of said third actuator being pivotally connected to said second slide, one end of said second and fourth actuators being pivotally connected to said rear surface of said plow, the other end of said second actuator being pivotally connected to said hinge member, the other end of said fourth actuator being pivotally connected to said second hinge member.

28. The plow assembly of claim 27, wherein each of said hinge member and said second hinge member is pivotally connected to said first and second slides along a corresponding generally vertical pivot axis, said other end of said second actuator being pivotally connected to said hinge member at a distance from said corresponding vertical pivot axis, said other end of said fourth actuator being pivotally connected to said second hinge member at a distance from said corresponding vertical pivot axis.

29. The plow assembly of claim 26, wherein said first and second actuators are sequentially operable via a switching device to continuously move said plow wing between an aligned and retracted position and an extended and forwardly angled position, said second and third actuators being sequentially operable to continuously move said second plow wing between an aligned and retracted position and an extended and forwardly angled position.

30. The plow assembly of claim 29, wherein said first and third actuators are operable first to move a respective outer wing portion to an extended and aligned position and said second and fourth actuators are operable second to move the respective plow wing from said extended and aligned position to said forwardly angled position in response to said switching device.

31. The plow assembly of claim 29, wherein said second and fourth actuators are operable first to move a respective plow wing to a retracted and forwardly angled position and said first and third actuators are operable second to move the respective outer wing portion to an extended and forwardly angled position in response to said switching device.

32. The plow assembly of claim 29, wherein said switching device comprises at least one of a sequencing valve and an electronic limit switch.

33. A plow assembly for vehicles, said assembly comprising:

a plow having first and second ends, a front material engaging surface, a rear surface opposite said front surface, a first hinge at said first end and a second hinge at said second end;

a support for attaching said plow to the vehicle;

first and second extendable plow wings, each of said plow wings having inner and outer portions, each of said inner and outer portions including a moldboard having a front material engaging surface, and a rear surface opposite said front surface, said first plow wing being mounted at said first hinge, said second wing being mounted at said second hinge, each of said outer portions of said plow wings being movable relative to said inner portion between a retracted position in which an outer end of said outer portion is adjacent an outer end of its respective inner portion, and an extended position in which said outer end of said outer portion is spaced outwardly from said retracted position;

each plow wing being pivotally mounted on said hinges for movement between an aligned position in which said front surface of said plow wing is generally aligned with said front surface of said plow, and a forwardly angled position in which said front surface of said plow wing extends at an angle to said front surface of said plow; and at least two actuators including a first actuator operable to move said first plow wing and a second actuator operable to move said second plow wing, each of said plow wings being operable independently of the other plow wing such that said plow wings are independently movable between said respective retracted, extended, aligned and forwardly angled positions, said plow wings forming a general U-shape with said plow when both plow wings are in their forwardly angled positions to facilitate pushing material being plowed without such material slipping off the plow ends.

34. The plow assembly of claim 33 further including at least one stop member which limits movement of said outer portions of said first and second plow wings along said inner portions of said first and second plow wings.

35. The plow assembly of claim 33 including first and second slides which are movably mounted along said rear surface of said moldboard of said inner portion of said plow wings, said outer portion of said first plow wing being mounted on and movable with said first slide, said outer portion of said second plow wing being mounted on and movable with said second slide.

36. The plow assembly of claim 35, wherein each slide is telescopically mounted within at least one housing on said rear surface of said inner portion of a respective plow wing.

37. The plow assembly of claim 36, wherein each of said first and second slides is spaced from a respective one of said moldboards of said outer portions of said first and second plow wings, said moldboard of said inner portion of said first plow wing being slidably positioned between said first slide and said moldboard of said outer portion of said first plow wing, said moldboard of said inner portion of said second plow wing being slidably positioned between said second slide and said moldboard of said outer portion of said second plow wing.

38. The plow assembly of claim 35, wherein said first and second actuators comprise first and second pairs of actuators.

39. The plow assembly of claim 38, wherein each of said actuators of each of said pairs of actuators has two ends, one end of one of said actuators in each pair being pivotally connected to said rear surface of said plow, the other end of said one actuator in each pair being pivotally connected to a respective one of said first and second hinges, one end of the other of said actuators in each pair being pivotally connected to a respective one of said first and second slides, the other end of said other actuator in each pair being pivotally connected to said inner portion of a respective one of said plow wings.

40. The plow assembly of claim 38, wherein each of said first and second hinges is pivotally mounted to its respective plow end along a generally vertical pivot axis, said other end of said one actuator in each pair being pivotally connected to said respective hinge at a distance from said pivot axis.

41. The plow assembly of claim 37, wherein each of said actuators of said first and second pairs of actuators is sequentially operable with the other actuator of said first and second pairs of actuators to continuously move said plow wings between an aligned and retracted position and an extended and forwardly angled position.

42. The plow assembly of claim 41, wherein said actuators of each of said pairs of actuators are sequentially operable such that said plow wings are first movable from said aligned and retracted position to a retracted and forwardly angled position and are second movable from said retracted and forwardly angled position to said extended and forwardly angled position.

43. The plow assembly of claim 41, wherein said actuators of each of said pairs of actuators are sequentially operable such that said plow wings are first movable from said aligned and retracted position to an aligned and extended position and are second movable from said aligned and extended position to said extended and forwardly angled position.

44. The plow assembly of claim 41, wherein said actuators of said first and second pairs are sequentially operable in response to at least one of a sequencing valve and an electronic limit switch.

45. The plow assembly of claim 33, wherein the vehicle has a longitudinal axis generally aligned with the direction of motion of the vehicle when traveling in forward or reverse, said support including a support frame for attaching said plow to the front of the vehicle, said plow being pivotally mounted on said support frame for movement about a first, generally vertical pivot axis from a centered position extending generally transverse to the longitudinal axis of the vehicle to a series of angled positions in which said plow is angled to the left or right of said centered position.

46. The plow assembly of claim 45, wherein said plow is pivotally connected to said support frame about a second, generally horizontal pivot axis to allow forward pivotal movement of said plow and plow wings in unison when at least one of said plow and plow wings encounter an obstacle during plowing.

47. The plow assembly of claim 46 including a third actuator for pivotally moving said plow and said plow wings about said first pivot axis, said third actuator having two ends, one end being pivotally connected to said support frame, the other end being pivotally connected to said plow.

48. The plow assembly of claim 33, wherein each of said first and second ends of said plow are curved to correspond to a curvature of said front surface of said plow wings to close any gap between said front surface of said inner portion of said first and second plow wings and said first and second plow ends when said plow wings are angled forwardly.

49. The plow assembly of claim 33, wherein said front surface of said plow and said front surfaces of said inner and outer portions of said plow wings are generally continuous and uninterrupted surfaces.

50. A plow assembly for vehicles, the vehicle having a longitudinal axis generally aligned with the direction of motion of the vehicle when traveling in forward or reverse, said assembly comprising:

a plow having first and second ends, a front material engaging surface, a rear surface opposite said front surface, a first hinge at said first end and a second hinge at said second end, said front material engaging surface of said plow having a generally continuous surface;

a support for attaching said plow to the vehicle;

first and second extendable plow wings, each plow wing having inner and outer portions, each of said portions including a moldboard having a front material engaging surface, and a rear surface opposite said front surface, each of said outer portions of said plow wings being movable between a retracted position in which an outer end of said outer portion is adjacent an outer end of its respective inner portion, and an extended position in which said outer end of said outer portion is spaced outwardly from said retracted position;

each plow wing being pivotally mounted on a respective one of said first and second hinges for movement between an aligned position in which said front surface of said plow wing and said front surface of said plow are generally aligned, and a forwardly angled position in which said front surface of said plow wing extends at an angle to said front surface of said plow;

first and second slides movable along said rear surface of said moldboard of said inner portions of a respective plow wing, said moldboard of said outer portion of said first plow wing being mounted on and movable with said first slide, said moldboard of said outer portion of said second plow wing being mounted on and movable with said second slide, said moldboards being spaced from their respective slide such that said moldboard of said inner portion is slidably positioned between said moldboard of a respective one of said outer portions and a respective one of said first and second slides; and two pair of extendable actuators including a first pair of actuators operable to move said first plow wing, and a second pair of actuators operable to move said second plow wing, each of said actuators and said plow wings being operable independently of the other actuators and plow wing such that said plow wings are independently movable between said respective, retracted, extended, aligned and forwardly angled positions.

51. The plow assembly of claim 50, wherein said plow is pivotally mounted on said support frame for movement about a first, generally vertical pivot axis from a centered position extending generally transverse to the longitudinal axis of the vehicle to a series of angled positions in which said plow is angled to the left or right of said centered position.

52. The plow assembly of claim 50, wherein said moldboard of each of said plow wings has a cross-sectional contour generally corresponding to a cross-sectional contour of said plow.

* * * * *